US007211963B2

(12) United States Patent
Onozawa et al.

(10) Patent No.: US 7,211,963 B2
(45) Date of Patent: May 1, 2007

(54) CAPACITIVE LOAD DRIVING CIRCUIT FOR DRIVING CAPACITIVE LOADS SUCH AS PIXELS IN PLASMA DISPLAY PANEL, AND PLASMA DISPLAY APPARATUS

(75) Inventors: Makoto Onozawa, Kawasaki (JP); Shigetoshi Tomio, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 59 days.

(21) Appl. No.: 11/072,604

(22) Filed: Mar. 7, 2005

(65) Prior Publication Data

US 2005/0258770 A1 Nov. 24, 2005

(30) Foreign Application Priority Data

May 18, 2004 (JP) ..... 2004-147752

(51) Int. Cl.
*G09G 3/10* (2006.01)

(52) U.S. Cl. ..... 315/169.3; 315/169.1; 345/212; 345/76

(58) Field of Classification Search .. 315/169.1–169.4; 345/60, 67, 68, 90, 211–214, 76, 77
See application file for complete search history.

(56) References Cited

U.S. PATENT DOCUMENTS 5,442,370 A * 8/1995 Yamazaki et al. ..... 345/94
6,496,166 B1 * 12/2002 Onozawa et al. ..... 345/60
6,582,043 B2 * 6/2003 Ishizaki ..... 347/12
6,686,912 B1 2/2004 Kishi et al. ..... 345/211
6,803,889 B2 * 10/2004 Onozawa et al. ..... 345/60
7,015,905 B2 * 3/2006 Onozawa et al. ..... 345/212
2002/0097203 A1 7/2002 Onozawa et al. ..... 345/60

FOREIGN PATENT DOCUMENTS

| | | |
|---|---|---|
| EP | 1139323 | 10/2001 |
| JP | 2001-282181 | 10/2001 |
| JP | 2002-62844 | 2/2002 |
| JP | 2002-215087 | 7/2002 |

* cited by examiner

*Primary Examiner*—Haissa Philogene
(74) *Attorney, Agent, or Firm*—Staas & Halsey LLP

(57) ABSTRACT

A capacitive load driving circuit has an input terminal, a front-edge delay circuit delaying a front edge of an input signal input via the input terminal, a back-edge delay circuit delaying a back edge of the input signal, an amplifying circuit amplifying a drive control signal obtained through the front-edge delay circuit and the back-edge delay circuit, and an output switch device which is driven by the amplifying circuit. The front-edge delay circuit includes a first time-constant circuit having a first resistor and a first capacitor, the back-edge delay circuit includes a second time-constant circuit having a second resistor and a second capacitor, and the drive control signal is generated by a signal combining circuit which combines an output signal of the first-time constant circuit with an output signal of the second-time constant circuit.

28 Claims, 20 Drawing Sheets

51 (52~53)

Fig.7A
(PRIOR ART)
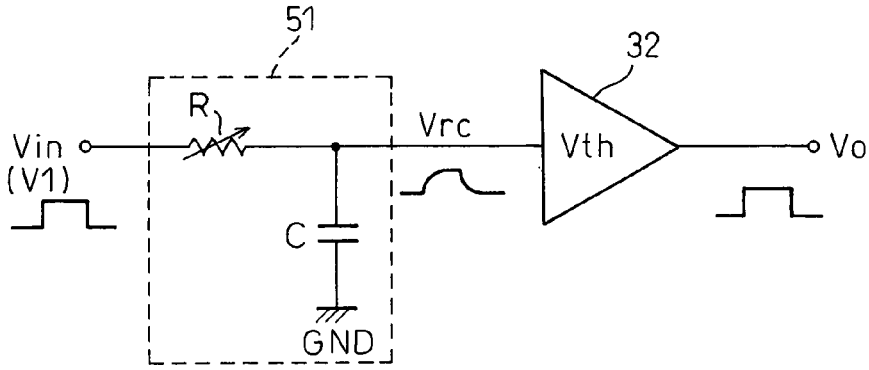
Fig.7B
(PRIOR ART)
Fig.7C
(PRIOR ART)
Fig.7D
(PRIOR ART)
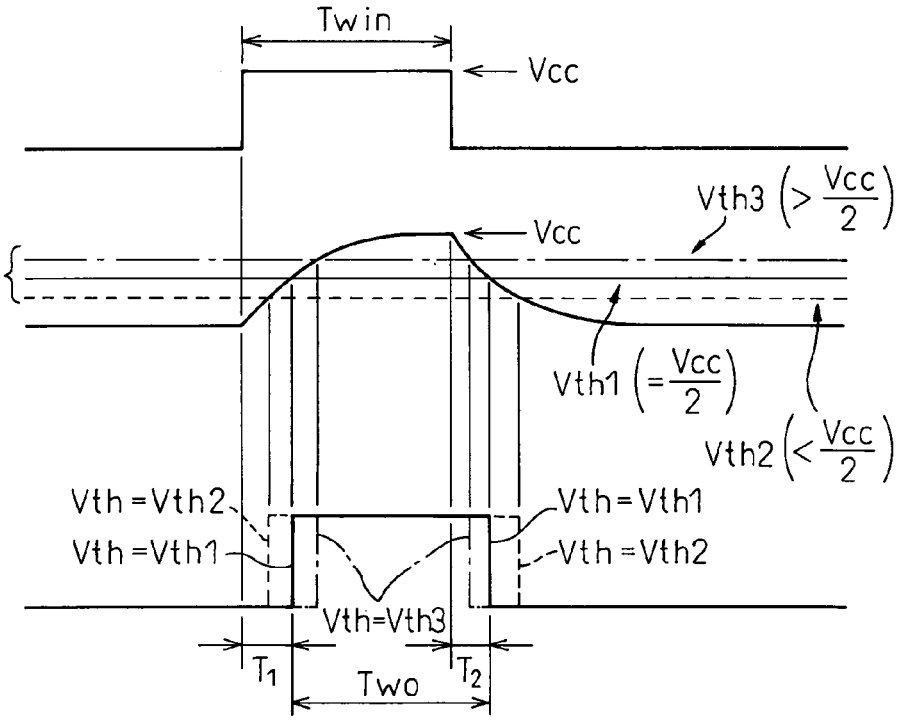

CAPACITIVE LOAD DRIVING CIRCUIT FOR DRIVING CAPACITIVE LOADS SUCH AS PIXELS IN PLASMA DISPLAY PANEL, AND PLASMA DISPLAY APPARATUS

CROSS REFERENCE TO RELATED APPLICATION

This application is based upon and claims the benefit of priority from the prior Japanese Patent Application No. 2004-147752 filed on May 18, 2004, the entire contents of which are incorporated herein by reference.

BACKGROUND OF THE INVENTION

1. Field of the Invention

The present invention relates to a capacitive load driving circuit and a plasma display apparatus, and more particularly to a capacitive load driving circuit for driving capacitive loads such as pixels in a plasma display panel (PDP), and also to a plasma display apparatus.

2. Description of the Related Art

In recent years, plasma display apparatuses have been commercially implemented as thin display apparatuses. Here, in a capacitive load driving circuit for driving capacitive loads such as pixels in a plasma display panel, when delay time is adjusted using a delay circuit, the pulse width of a sustain pulse may vary.

For example, if the pulse width of a sustain pulse increases, a reduction in time margin, the occurrence of an abnormal current, etc. may result. Conversely, if the pulse width of a sustain pulse decreases, noise may be superimposed on the rising and falling waveforms of a sustain voltage, which can reduce the operating margin of the plasma display apparatus and can cause screen flicker.

It is therefore desired to provide a capacitive load driving circuit that can supply a proper output voltage to the capacitive load by reducing the variation in output pulse width that occurs in such cases as when the delay time is adjusted using a delay circuit. It is also desired to provide a plasma display apparatus that can supply a plasma display panel with a drive voltage free from such problems as the reduction of time margin, the occurrence of abnormal current, the superimposition of noise, etc.

In the prior art, there is proposed a plasma display apparatus that has a sustain circuit designed so as to eliminate variations in the rise/fall timing and the shape of sustain pulses, and thereby achieves low power consumption while preventing malfunctioning (for example, Japanese Unexamined Patent Publication (Kokai) No. 2001-282181: EP-1139323-A2).

In the prior art, there are also proposed a driving apparatus, a driving method, and a driving circuit for a plasma display panel that aim to simplify the circuit configuration and to reduce the manufacturing cost by reducing the breakdown voltages of the devices contained in the driving apparatus (for example, Japanese Unexamined Patent Publication (Kokai) No. 2002-062844: U.S. Pat. No. 6,686,912-B1).

Further, in a driving apparatus for an AC PDP, if a power recovery circuit fails to operate properly, output loss in the driving apparatus increases, increasing the amount of heat generated by each component forming the driving apparatus; to address this problem, there is proposed in the prior art a plasma display apparatus that does not need to construct the driving apparatus by using high-breakdown voltage devices, and yet can prevent damage such as device breakdown in the event of a malfunction of the power recovery circuit (for example, Japanese Unexamined Patent Publication (Kokai) No. 2002-215087: US-2002/0097203-A1).

The prior art and its associated problems will be described in detail later with reference to the accompanying drawings.

SUMMARY OF THE INVENTION

According to the present invention, there is provided a capacitive load driving circuit comprising an input terminal; a front-edge delay circuit delaying a front edge of an input signal input via the input terminal; a back-edge delay circuit delaying a back edge of the input signal; an amplifying circuit amplifying a drive control signal obtained through the front-edge delay circuit and the back-edge delay circuit; and an output switch device which is driven by the amplifying circuit, wherein the front-edge delay circuit includes a first time-constant circuit comprising a first resistor and a first capacitor, the back-edge delay circuit includes a second time-constant circuit comprising a second resistor and a second capacitor, and the drive control signal is generated by a signal combining circuit which combines an output signal of the first-time constant circuit with an output signal of the second-time constant circuit.

A buffer circuit may be provided at a front end of either one or each of the first and second time-constant circuits. The signal combining circuit may be an AND gate. Delay time of the front edge may be adjusted by adjusting the value of the first resistor in the first time-constant circuit, and delay time of the back edge may be adjusted by adjusting the value of the second resistor in the second time-constant circuit. Delay time of the front edge may be adjusted by adjusting the value of the first capacitor in the first time-constant circuit, and delay time of the back edge may adjusted by adjusting the value of the second capacitor in the second time-constant circuit.

Further, according to the present invention, there is provided a capacitive load driving circuit for a matrix-addressed flat panel display apparatus which applies a prescribed voltage to a capacitive load that forms a display element, comprising a first signal line supplying a first potential to one end of the capacitive load; a first switch device supplying the first potential to the first signal line; a first drive circuit driving the first switch device; a second switch device supplying a second potential to the first signal line; a second drive circuit driving the second switch device; a second signal line supplying a third potential to the one end of the capacitive load, the third potential being different from the first potential; a first capacitor connected between the first signal line and the second signal line and capable of supplying a potential lower than the first and the second potential to the first signal line; a third switch device supplying the second potential to the second signal line; a third drive circuit driving the third switch device; a fourth switch device connecting the first signal line to the one end of the capacitive load; a fourth drive circuit driving the fourth switch device; a fifth switch device connecting the second signal line to the one end of the capacitive load; a fifth drive circuit driving the fifth switch device; and a coil circuit which is connected between at least one of the first and second signal lines and a supply line supplying the second potential, wherein the capacitive load driving circuit further includes, at a front end of one of the first to fifth drive circuits, an input terminal, a front-edge delay circuit delaying a front edge of an input signal input via the input terminal, and a back-edge delay circuit delaying a back edge of the input signal.

The input terminal, the front-edge delay circuit delaying the front edge of the input signal input via the input terminal, and the back-edge delay circuit delaying the back edge of the input signal may be provided at the front end of the first drive circuit. The capacitive load driving circuit may further include, at the front end of the second drive circuit, an input terminal, and a front-edge delay circuit delaying the front edge of an input signal input via the input terminal. The capacitive load driving circuit may further include, at the front end of the fifth drive circuit, an input terminal, and a front-edge delay circuit delaying the front edge of an input signal input via the input terminal, and may also include, at the front end of each of the second and fourth drive circuits, an input terminal, and a front-edge delay circuit delaying the front edge of an input signal input via the input terminal.

The third switch device may comprise a current output device and a current input device, and the third drive circuit may comprise a current output device drive circuit driving the current output device and a current input device drive circuit driving the current input device. The current output device may be a P-channel power MOSFET, and the current input device may be an N-channel power MOSFET or an IGBT.

A front-edge delay circuit delaying the front edge of a driving signal to be supplied to the current output device drive circuit and a back-edge delay circuit delaying the back edge of the driving signal to be supplied to the current output device drive circuit may be provided at the front end of the current output device drive circuit. A front-edge delay circuit delaying the front edge of a driving signal to be supplied to a corresponding one of the drive circuits and a back-edge delay circuit delaying the back edge of the driving signal to be supplied to the corresponding drive circuit may be provided at the front end of each of the first drive circuit, the second drive circuit, the fourth drive circuit, the fifth drive circuit, the current output device drive circuit, and the current input device drive circuit.

The front-edge delay circuit may include a first time-constant circuit comprising a first resistor and a first capacitor; the back-edge delay circuit includes a second time-constant circuit comprising a second resistor and a second capacitor; and drive control signals to be supplied to the first to fifth drive circuits are each generated by a signal combining circuit which combines an output signal of the first-time constant circuit with an output signal of the second-time constant circuit. A buffer circuit may be provided at a front end of either one or each of the first and second time-constant circuits.

The signal combining circuit may be an AND gate. Delay time of the front edge may be adjusted by adjusting the value of the first resistor in the first time-constant circuit, and delay time of the back edge may be adjusted by adjusting the value of the second resistor in the second time-constant circuit. Delay time of the front edge may be adjusted by adjusting the value of the first capacitor in the first time-constant circuit, and delay time of the back edge may be adjusted by adjusting the value of the second capacitor in the second time-constant circuit.

A gate coupler constructed by using a light-emitting device, a light-receiving device, and an amplifying circuit may be employed for at least one of the first to fifth drive circuits. The gate coupler may be employed for each of the fourth and fifth drive circuits. The gate coupler may be employed for each of the first, second, fourth, and fifth drive circuits.

According to the present invention, there is also provided a plasma display apparatus comprising a plurality of X electrodes; a plurality of Y electrodes which are arranged substantially parallel to the plurality of X electrodes, and which produce a discharge between the plurality of Y electrodes and the plurality of X electrodes; an X-electrode driving circuit which applies a discharge voltage to the plurality of X electrodes; and a Y-electrode driving circuit which applies a discharge voltage to the plurality of Y electrodes, and wherein the X-electrode driving circuit or the Y-electrode driving circuit is constructed using a capacitive load driving circuit, wherein the capacitive load driving circuit comprises an input terminal; a front-edge delay circuit delaying a front edge of an input signal input via the input terminal; a back-edge delay circuit delaying a back edge of the input signal; an amplifying circuit amplifying a drive control signal obtained through the front-edge delay circuit and the back-edge delay circuit; and an output switch device which is driven by the amplifying circuit, wherein the front-edge delay circuit includes a first time-constant circuit comprising a first resistor and a first capacitor, the back-edge delay circuit includes a second time-constant circuit comprising a second resistor and a second capacitor, and the drive control signal is generated by a signal combining circuit which combines an output signal of the first-time constant circuit with an output signal of the second-time constant circuit.

Further, according to the present invention, there is provided a plasma display apparatus comprising a plurality of X electrodes; a plurality of Y electrodes which are arranged substantially parallel to the plurality of X electrodes, and which produce a discharge between the plurality of Y electrodes and the plurality of X electrodes; an X-electrode driving circuit which applies a discharge voltage to the plurality of X electrodes; and a Y-electrode driving circuit which applies a discharge voltage to the plurality of Y electrodes, and wherein the X-electrode driving circuit or the Y-electrode driving circuit is constructed using a capacitive load driving circuit which applies a prescribed voltage to a capacitive load that forms a display element, wherein the capacitive load driving circuit comprises a first signal line supplying a first potential to one end of the capacitive load; a first switch device supplying the first potential to the first signal line; a first drive circuit driving the first switch device; a second switch device supplying a second potential to the first signal line; a second drive circuit driving the second switch device; a second signal line supplying a third potential to the one end of the capacitive load, the third potential being different from the first potential; a first capacitor connected between the first signal line and the second signal line and capable of supplying a potential lower than the first and the second potential to the first signal line; a third switch device supplying the second potential to the second signal line; a third drive circuit driving the third switch device; a fourth switch device connecting the first signal line to the one end of the capacitive load; a fourth drive circuit driving the fourth switch device; a fifth switch device connecting the second signal line to the one end of the capacitive load; a fifth drive circuit driving the fifth switch device; and a coil circuit which is connected between at least one of the first and second signal lines and a supply line supplying the second potential, wherein the capacitive load driving circuit further includes, at a front end of one of the first to fifth drive circuits, an input terminal, a front-edge delay circuit delaying a front edge of an input signal input via the input terminal, and a back-edge delay circuit delaying a back edge of the input signal.

The capacitive load driving circuit may be a sustain circuit supplying sustain pulses to a plasma display panel during a sustain period. The capacitive load driving circuit may be a scan circuit supplying scan pulses to a plasma display panel during a scan period. The capacitive load driving circuit may be a sustain/scan common circuit supplying, to a plasma display panel, sustain pulses during a sustain period and scan pulses during a scan period.

BRIEF DESCRIPTION OF THE DRAWINGS

The present invention will be more clearly understood from the description of the preferred embodiments as set forth below with reference to the accompanying drawings, wherein:

FIGS. 7A, 7B, 7C, and 7D are diagrams for explaining the relationship between threshold voltage and output pulse width for an amplifying circuit in the prior art sustain circuit;

DESCRIPTION OF THE PREFERRED EMBODIMENTS

In recent years, plasma display panels have been commercially implemented as display panels to replace traditional CRTs, because the plasma display provides excellent visibility due to its self emissive nature, is thin in structure, and can achieve a large-screen, fast-response display.

Before describing in detail the preferred embodiments of a capacitive load driving circuit and a plasma display apparatus according to the present invention, a capacitive load driving circuit and a plasma display apparatus according to the prior art and their associated problems will be described below with reference to drawings.

Figure 1:
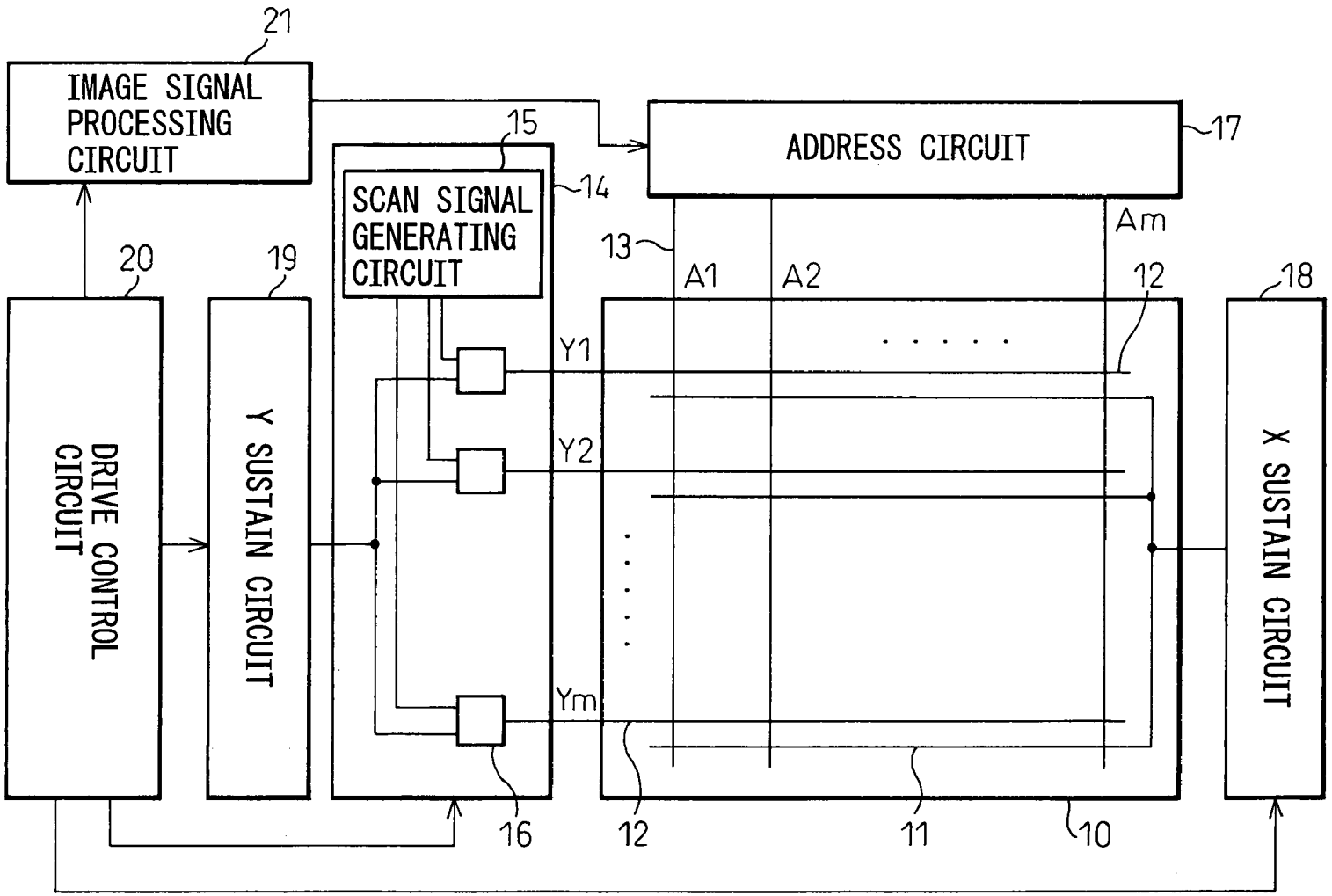
FIG. 1 is a general configuration diagram schematically showing a plasma display apparatus to which the present invention is applied.

FIG. 1 is a general configuration diagram schematically showing a plasma display apparatus to which the present invention is applied; the plasma display apparatus shown here is a conventional three-electrode surface-discharge AC plasma display apparatus. In FIG. 1, reference numeral 10 is a PDP, 11 is a first electrode (X electrode), 12 is a second electrode (Y electrode), 13 is an address electrode, and 14 is a scan driver.

As shown in FIG. 1, in the conventional PDP 10, a number, n, of X electrodes 11 and an equal number of Y electrodes 12 (Y1 to Yn) are arranged in interleaving fashion with one alternating with the other, forming n pairs each consisting of an X electrode 11 and its adjacent Y electrode 12, and the emission of light for display is caused to occur between the X electrode 11 and the Y electrode 12 in each pair. The Y electrodes and the X electrodes are called the display electrodes; they are also sometimes called the sustain electrodes. A number, m, of address electrodes 13 (A1 to Am) are arranged at right angles to the display electrodes, and a display cell is formed at an intersection between each address electrode 13 and each pair of X electrode 11 and Y electrode 12.

The Y electrodes 12 are connected to the scan driver 14. The scan driver 14 includes switches 16 the number of which is equal to the number of Y electrodes, and the switches 16 are switched so that scan pulses from a scan signal generating circuit 15 are applied in sequence during an address period, and so that sustain pulses from a Y sustain circuit 19 are applied simultaneously during a sustain-discharge period. The X electrodes 11 are connected in common to an X sustain circuit 18, and the address electrodes 13 are connected to an address driver 17. An image signal processing circuit 21 supplies an image signal to the address circuit 17 after converting it into a form that can be handled within the plasma display apparatus. A drive control circuit 20 generates and supplies signals for controlling the various parts of the plasma display apparatus.

Figure 2:
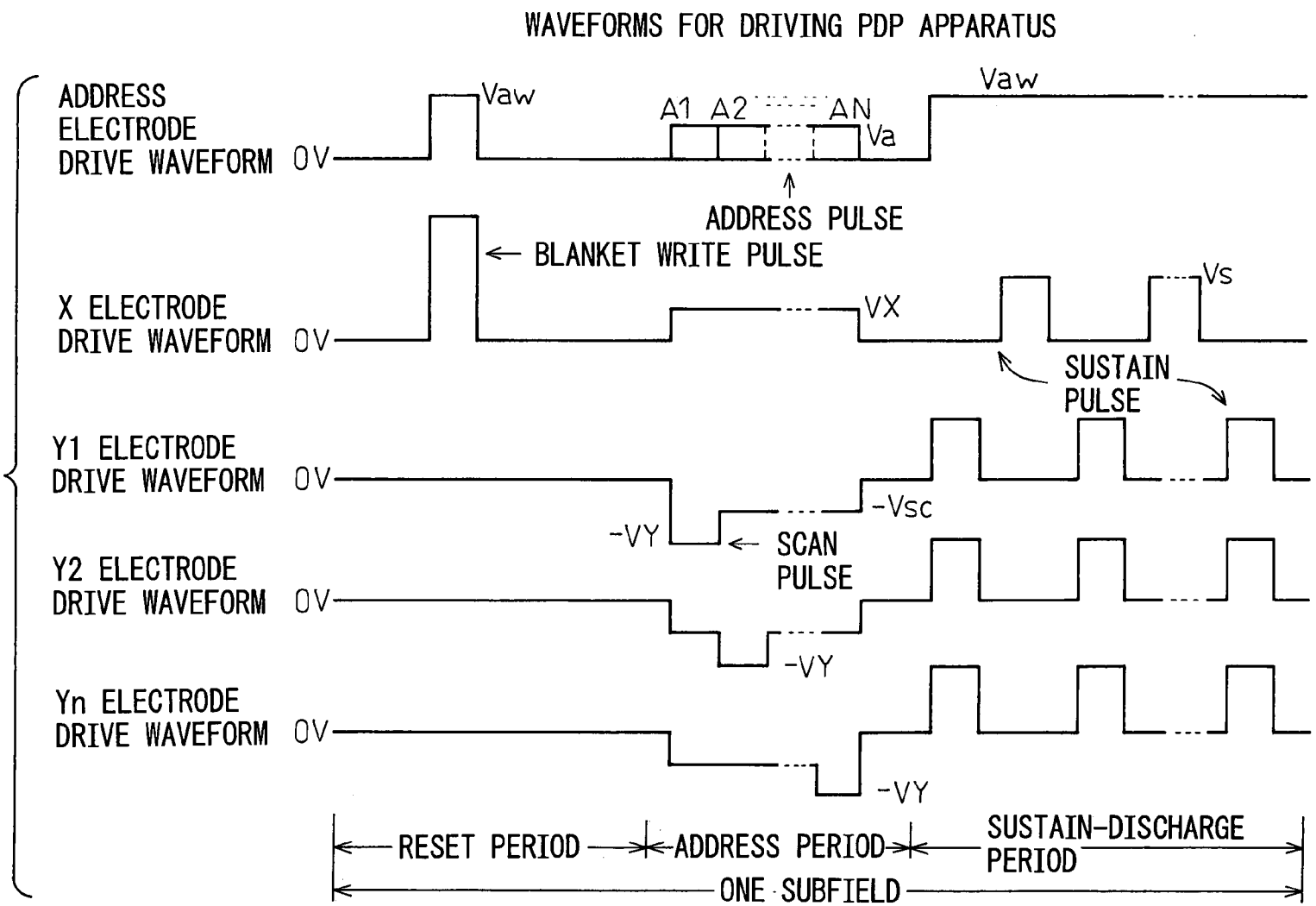
FIG. 2 is a diagram showing waveforms for driving the plasma display apparatus shown in FIG. 1.

FIG. 2 is a diagram showing waveforms for driving the plasma display apparatus shown in FIG. 1.

The plasma display apparatus displays a screen by refreshing the screen at predetermined intervals of time, and one display period is called one field. To achieve grayscale display, one field is further divided into a plurality of subfields, and the display is produced by combining the subfields for light emission for each display cell. Each subfield consists of a reset period in which all the display cells are initialized, an address period in which all the display cells are set to the states corresponding to the image to be displayed, and a sustain-discharge (sustain) period in which each display cell is caused to emit light according to the thus set state. During the sustain-discharge period, sustain pulses are applied to the X electrodes and Y electrodes in alternating fashion, causing the sustain-discharge to occur in the display cells that have been set in the address period to emit light, and thus maintaining the emission of light from the cells for display.

In the plasma display apparatus, a voltage of about 200 V at maximum needs to be applied in the form of high-frequency pulses between the electrodes during the sustain-discharge period; in particular, in the case of a grayscale display using the subfield display scheme, the pulse width is several microseconds. Since the plasma display apparatus is driven by such a high-voltage, high-frequency signal, the power consumption of the plasma display apparatus is generally large, and it is desired to reduce the power consumption.

Figure 3:
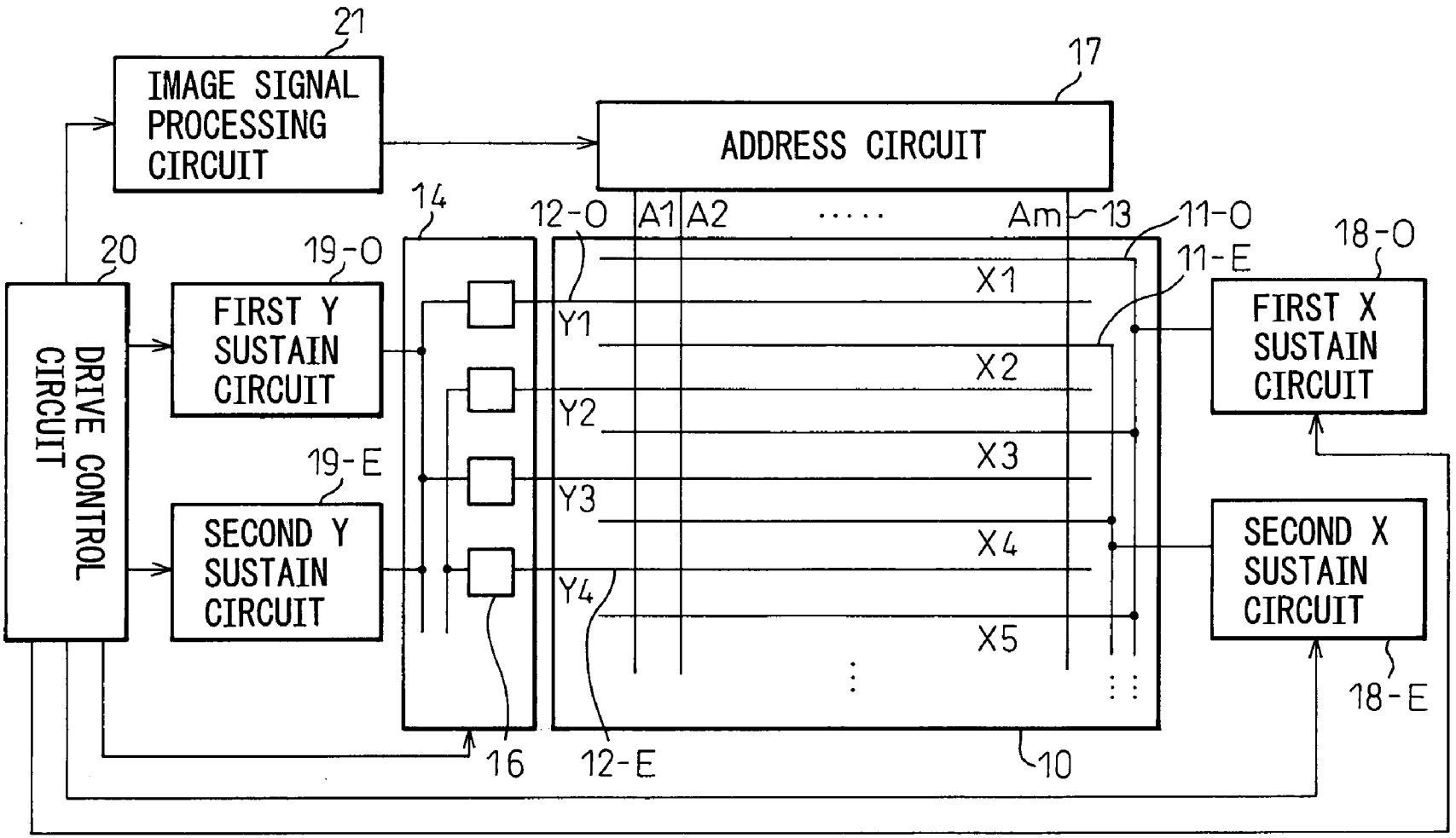
FIG. 3 is a general configuration diagram schematically showing another example of the plasma display apparatus to which the present invention is applied.

FIG. 3 is a general configuration diagram schematically showing another example of the plasma display apparatus to which the present invention is applied; a plasma display apparatus employing a method called ALIS (Alternate Lighting of Surfaces) is shown here.

As shown in FIG. 3, in the PDP employing the ALIS method, a number, n, of Y electrode (second electrodes) 12-O and 12-E and a number, (n+1), of X electrodes (first electrodes) 11-O and 11-E are arranged alternately in interleaving fashion, and the emission of light for display is caused to occur between every adjacent display electrodes (Y electrode and X electrode). Accordingly, with (2*n*+1) display electrodes, 2*n* display lines are formed. That is, the ALIS method achieves a resolution twice as high by using substantially the same number of display electrodes as those used in the configuration of FIG. 1. Further, since effective use can be made of the discharge space, and since the amount of light blocked by the electrodes, etc. is reduced, the method has the advantage of being able to achieve high aperture ratio, and hence high brightness. In the ALIS method, the space between every adjacent display electrodes is used to produce a discharge for display, but such discharges cannot be made to occur simultaneously across the entire screen. Therefore, the so-called interlaced scanning technique is employed that produces the display by scanning the odd-numbered lines and the even-numbered lines in time division fashion. That is, in an odd-numbered field, the odd-numbered lines are scanned, and in an even-numbered field, the even-numbered lines are scanned, thus obtaining a complete display by combining the display produced in the odd-numbered field with the display produced in the even-numbered field.

The Y electrodes are connected to the scan driver 14. The scan driver 14 includes switches 16, which are switched so that scan pulses are applied in sequence during the address period, while during the sustain-discharge period, the odd-numbered Y electrodes 12-O are connected to a first Y sustain circuit 19-O and the even-numbered Y electrodes 12-E to a second Y sustain circuit 19-E. At this time, the odd-numbered X electrodes 11-O are connected to a first X sustain circuit 18-O and the even-numbered X electrodes 11-E to a second X sustain circuit 18-E. The address electrodes 13 are connected to the address driver 17. The image signal processing circuit 21 and the drive control circuit 20 perform the same operation as earlier described with reference to FIG. 1.

Figure 4A:
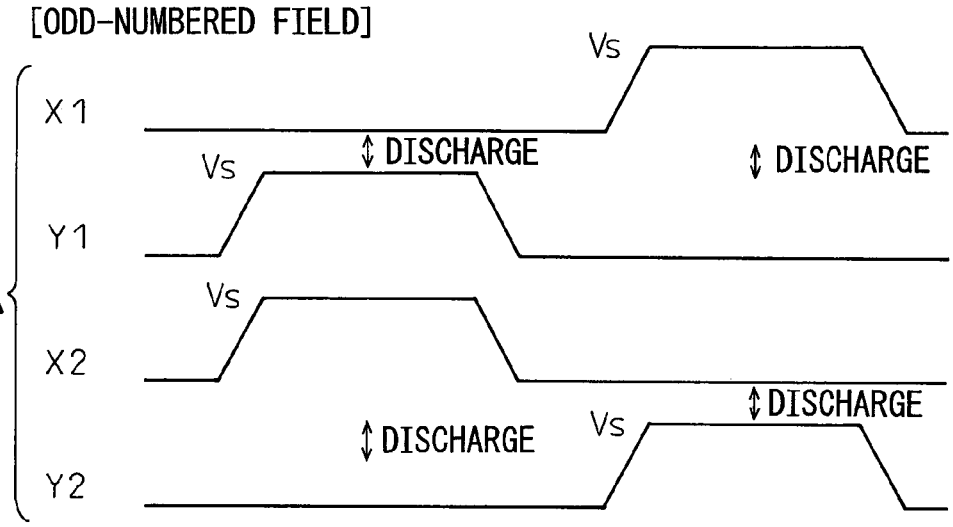
FIGS. 4A and 4B are diagrams showing the drive waveforms applied during a sustain-discharge period in the plasma display apparatus shown in FIG. 3.
Figure 4B:
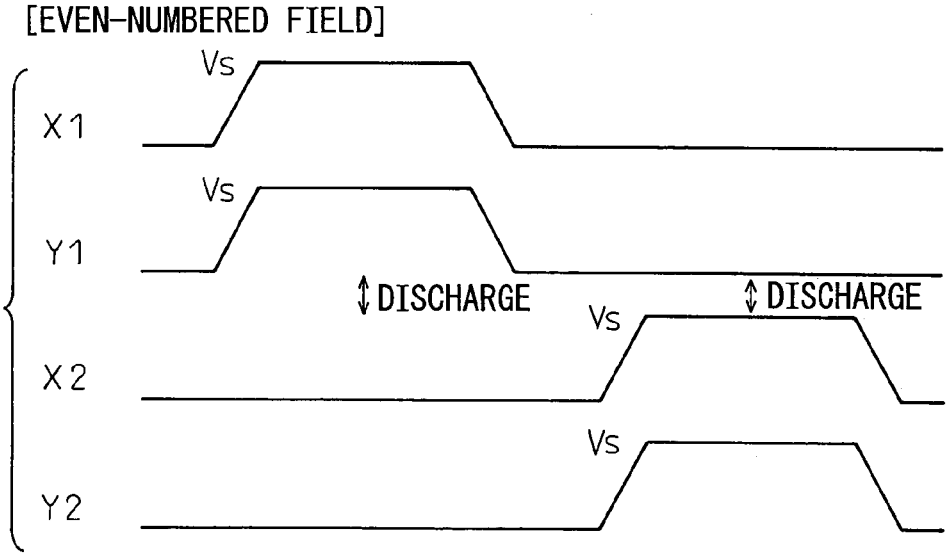

FIGS. 4A and 4B are diagrams showing the drive waveforms applied during the sustain-discharge period in the plasma display apparatus shown in FIG. 3: FIG. 4A shows the waveforms in the odd-numbered field, and FIG. 4B shows the waveforms in the even-numbered field. In the odd-numbered field, voltage Vs is applied to the electrodes Y1 and X2, while holding the electrodes X1 and Y2 to ground level, thus causing a discharge to occur between the electrodes X1 and Y1 and between the electrodes X2 and Y2, that is, on the odd-numbered display lines. At this time, no discharge occurs on the even-numbered display line between the electrodes Y1 and X2 because the potential difference between them is zero. Likewise, in the even-numbered field, voltage Vs is applied to the electrodes X1 and Y2, while holding the electrodes Y1 and X2 to ground level, thus causing a discharge to occur between the electrodes Y1 and X2 and between the electrodes Y2 and X1, that is, on the even-numbered display lines. Drive waveforms for the reset period and the address period will not be described here.

In the prior art, there is proposed a plasma display apparatus that has a sustain circuit designed so as to eliminate variations in the rise/fall timing and the shape of sustain pulses, and thereby achieves low power consumption while preventing malfunctioning (for example, Japanese Unexamined Patent Publication (Kokai) No. 2001-282181: EP-1139323-A2).

Figure 5:
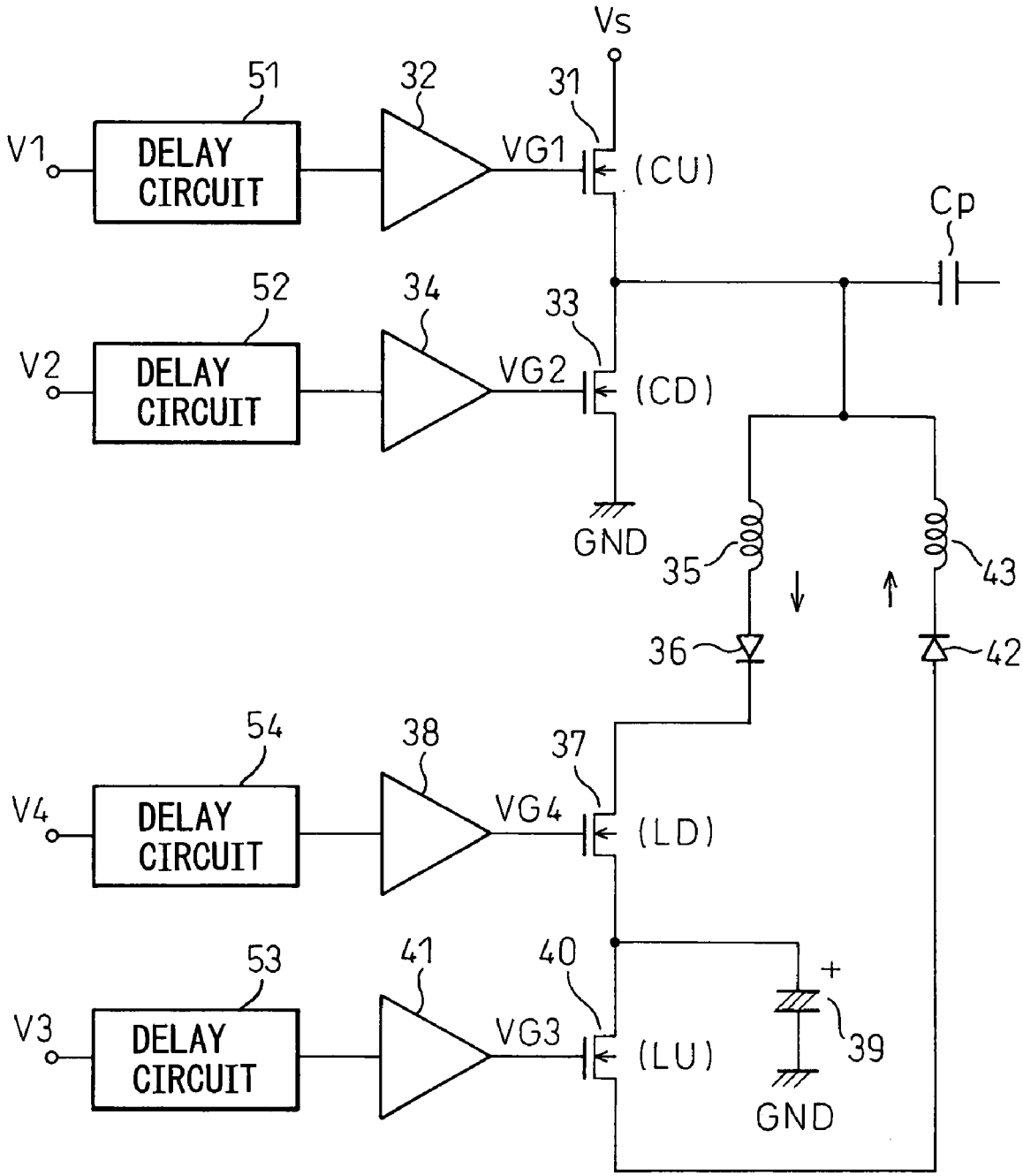
Fig. 5 (PRIOR ART)
FIG. 5 is a circuit diagram showing one example of a sustain circuit used in a prior art plasma display apparatus.

FIG. 5 is a circuit diagram showing one example of the sustain circuit (capacitive load driving circuit) used in the prior art plasma display apparatus; the sustain circuit shown here has a power recovery circuit in which a recovery path for recovering power and an application path for applying stored power are separated. A circuit for generating signals V1 to V4 is also provided, but not shown here. Reference character Cp indicates a drive capacitor (capacitive load) for the display cell formed between an X electrode and a Y electrode in the PDP (10). In FIG. 5, the sustain circuit for one of the electrodes is shown, but it will be noted that a similar sustain circuit is provided for the other electrode.

First, the sustain circuit without the power recovery circuit comprises switch devices (sustain output devices: n-channel MOS transistors) 31 and 33, amplifying circuits (drive circuits) 32 and 34, and delay circuits (front-edge delay circuits) 51 and 52; on the other hand, the power recovery circuit comprises switch devices 37 and 40, amplifying circuits 38 and 41, and delay circuits (front-edge delay circuits) 54 and 53.

The input signals V1 and V2 are input to the amplifying circuits 32 and 34 via the respective delay circuits 51 and 52, and the signals VG1 and VG2 output from the respective amplifying circuits 32 and 34 are supplied to the gates of the respective switch devices 31 and 33. Here, when the input signal V1 is at a high level "H", the switch device 31 turns on, and a high level "H" signal is applied to the electrode (X electrode or Y electrode). At this time, the input signal V2 is at a low level "L", and hence, the switch device 33 is OFF. At the same time that the input signal V1 goes to the low level "L", causing the switch device 31 to turn off, the input signal V2 goes to the high level "H", causing the switch device 33 to turn on, and ground level potential is thus applied to the electrode.

On the other hand, when applying a sustain pulse in the sustain circuit having the power recovery circuit, before the input signal V1 goes to the high level "H" the input signal V2 goes to the low level "L", thus causing the switch device 33 to turn off, after which the input signal V3 goes to the high level "H" and the switch device 40 turns on, forming a resonant circuit by a capacitor 39, diode 42, coil (inductance) 43, and capacitor Cp, and the power stored in the capacitor 39 is supplied to the electrode, causing the potential of the electrode to rise. Immediately before the rising of the electrode potential ends, the input signal V3 goes to the low level "L", causing the switch device 40 to turn off, and at the same time, the input signal V1 goes to the high level "H", causing the switch device 31 to turn on, and thus holding the electrode potential fixed at Vs.

When ending the application of the sustain pulse, first the input signal V1 goes to the low level "L" thus causing the switch device 31 to turn off, after which the input signal V4 goes to the high level "H" and the switch device 37 turns on, forming a resonant circuit by the capacitor 39, diode 36, coil 35, and capacitor Cp, and the charge stored in the capacitor Cp is supplied to the capacitor 39, thus causing the voltage at the capacitor 39 to rise. In this way, the power stored in the capacitor Cp by the sustain pulse applied to the electrode is recovered and stored into the capacitor 39. Immediately before the falling of the electrode potential ends, the input signal V4 goes to the low level "L", causing the switch device 37 to turn off, and at the same time, the input signal V2 goes to the high level "H", causing the switch device 33 to turn on, and thus holding the electrode potential fixed to ground. In the sustain-discharge period, the above operation is repeated as many times as there are sustain pulses. With the above configuration, power consumption associated with the sustain discharge can be reduced.

Figure 6:
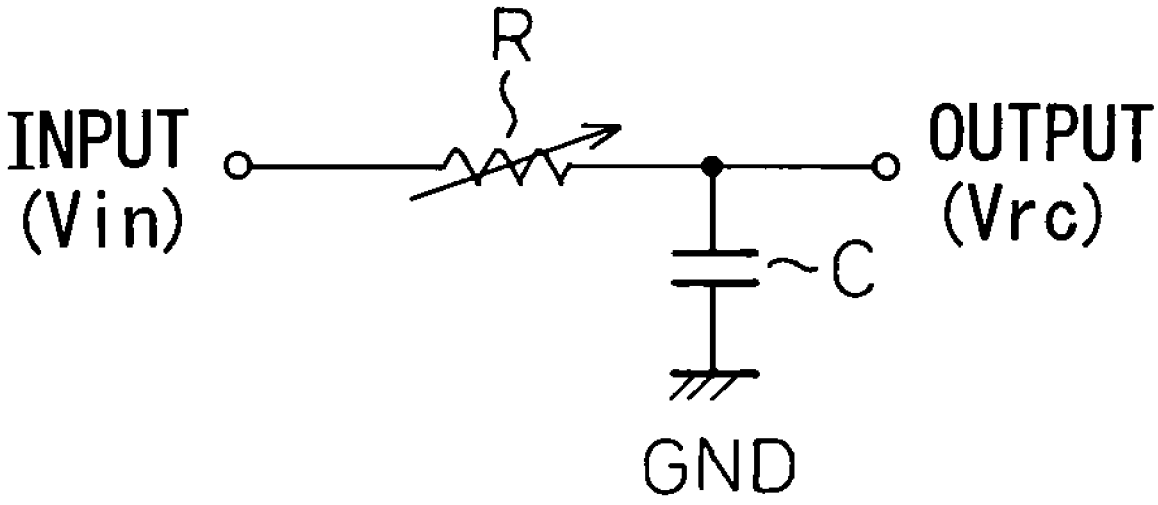
Fig. 6 (PRIOR ART)
FIG. 6 is a circuit diagram showing one example of a delay circuit in the sustain circuit shown in FIG. 5.

FIG. 6 is a circuit diagram showing one example of the delay circuit in the sustain circuit shown in FIG. 5.

As shown in FIG. 6, the delay circuit 51 (52 to 54), which is a circuit for delaying the front edge of the input signal V1 (V2 to V4) input via an input terminal, comprises a resistor (variable resistive element) R and a capacitor (capacitive element) C, and controls the delay time of the input signal by varying the resistance value of the resistor R. That is, the delay circuits 51, 52, 53, and 54 compensate for variations in the delay times of the respective amplifying circuits 32, 34, 41, and 38 connected at the subsequent stage, and thereby adjust the phase of the driving pulse to be applied to each switch device so that the switch devices 31, 33, 40, and 37 can be driven at proper timings.

It thus becomes possible to supply sustain pulses of correct timing to the plasma display panel, while suppressing an increase in power consumption caused by variations in the delay times of the amplifying circuits.

Figure 8A:
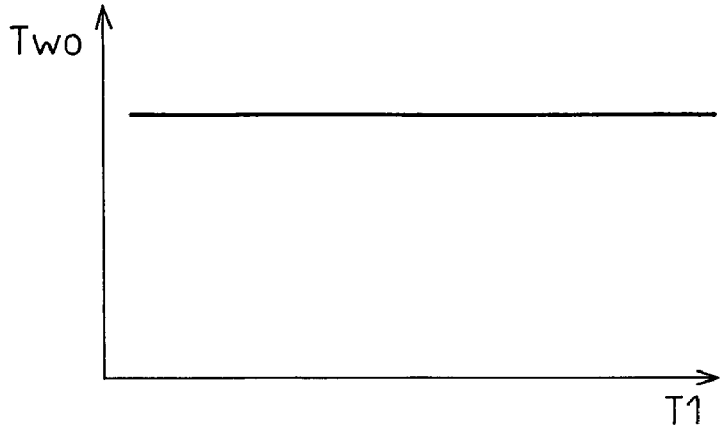
Fig.8A (PRIOR ART)
FIGS. 8A, 8B, and 8C are diagrams for explaining the relationship between delay time and output pulse width in the prior art sustain circuit.
Figure 8B:
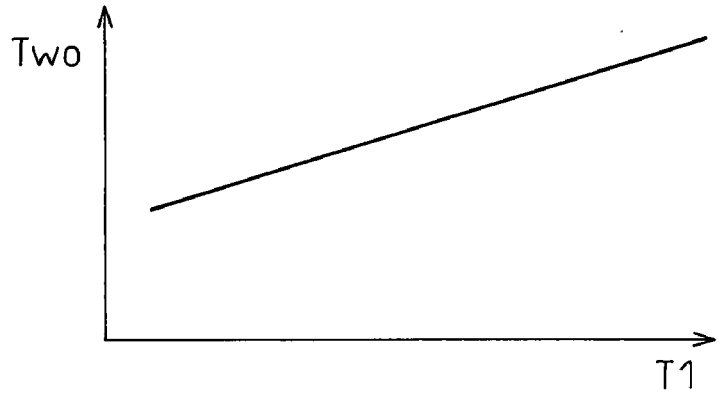
Fig.8B (PRIOR ART)
Figure 8C:
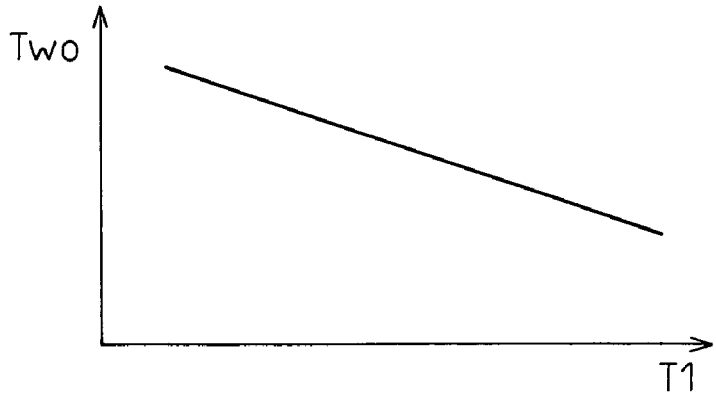
Fig.8C (PRIOR ART)
Figure 9:
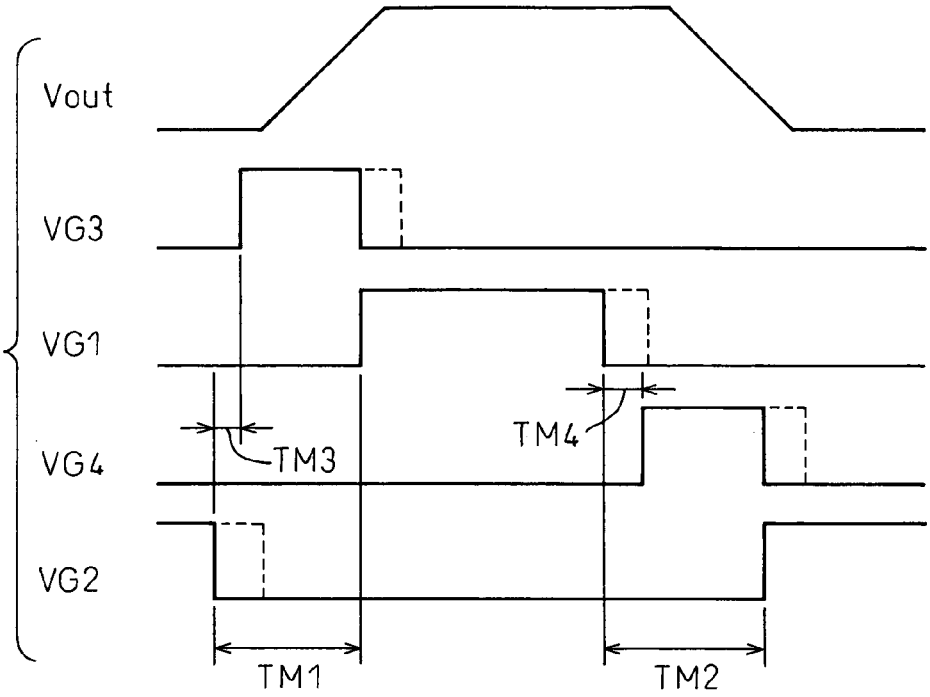
Fig.9 (PRIOR ART)
FIG. 9 is a diagram showing operating waveforms when the output pulse width is large in the prior art sustain circuit.

FIGS. 7A, 7B, 7C, and 7D are diagrams for explaining the relationship between threshold voltage and output pulse width for an amplifying circuit in the prior art sustain circuit, and more specifically for explaining the problem associated with the sustain circuit described above with reference to FIG. 5. Further, FIGS. 8A, 8B, and 8C are diagrams for explaining the relationship between delay time and output pulse width in the prior art sustain circuit, and FIG. 9 is a diagram showing operating waveforms when the output pulse width is large in the prior art sustain circuit.

FIG. 7A shows an essential circuit portion (delay circuit 51 and amplifying circuit 32) for driving one switch device (31); here, the circuit configuration of FIG. 6 is employed for the delay circuit (51) in the sustain circuit shown in FIG. 5. In the circuit of FIG. 7A, Vin (V1) designates the input signal, Vrc the voltage at the connection node between the resistor R and the capacitor C in the delay circuit 51, Vth the threshold voltage of the amplifying circuit 32, and Vo the output voltage of the amplifying circuit. The waveforms of the respective voltages Vin, Vrc, Vth, and Vo are then as shown in FIGS. 7B to 7D. For simplicity of explanation, the delay time in the amplifying circuit 32 is assumed to be zero. The above also applies to essential circuit portions constructed with other delay circuits (52, 53, and 54) and amplifying circuits (34, 41, and 38).

First, when the threshold voltage Vth of the amplifying circuit 32 is Vth=Vth1=Vcc/2 where Vcc is the high level "H" voltage of the input signal Vin, the delay time T1 of the front edge (rising edge) through the resistor R and capacitor C is equal to the delay time T2 of the back edge (falling edge). Accordingly, the pulse width Twin of the input signal is equal to the pulse width Two of the output signal Vo of the amplifying circuit 32. Even when the delay time T1 is increased by increasing the resistance value of the resistor R in the delay circuit 51, the pulse width Two remains constant (see FIG. 8A).

Next, when the threshold voltage Vth is Vth=Vth2<Vcc/2, the output waveform is as shown by a dashed line in FIG. 7D, that is, T1<T2, and hence Twin<Two. In this case, the relationship between T1 and Two is such that the pulse width Two of the output signal Vo increases with increasing delay time T1 as shown in FIG. 8B. The waveforms of the respective signals in the sustain circuit shown in FIG. 5 are then as shown by dashed lines in FIG. 9. In FIG. 9, solid lines show the waveforms when Twin=Two.

As a result, as shown in FIG. 9, the time margin TM1 allowed from the time the signal VG2 falls to the time the signal VG1 rises and the time margin TM2 allowed from the time the signal VG1 falls to the time the signal VG2 rises decrease. The time margins TM1 and TM2 are provided in order to prevent the switch devices 31 (switch device CU) and 33 (CD) from conducting simultaneously and causing a shoot-through current to flow. Such decreased time margins would lead to the degradation of circuit reliability.

Furthermore, as shown in FIG. 9, since the time TM3 from the time the signal VG2 falls to the time the signal VG3 rises and the time TM4 from the time the signal VG1 falls to the time the signal VG4 rises also decrease, simultaneous conduction of the switch devices 33 (CD) and 40 (LU) or the switch devices 31 (CU) and 37 (LD) may occur under certain circumstances, causing abnormal current to flow through these switch devices.

When the threshold voltage Vth is Vth=Vth3>Vcc/2, the output waveform is as shown by a semi-dashed line in FIG. 7D, that is, T1>T2, and hence Twin>Two. In this case, the relationship between T1 and Two is such that the pulse width (output pulse width) Two of the output signal Vo decreases with increasing delay time T1 as shown in FIG. 8C. The waveforms of the respective signals in the sustain circuit shown in FIG. 5 are then as shown by the dashed lines in FIG. 9. In FIG. 9, the solid lines show the waveforms when Twin=Two.

Figure 10:
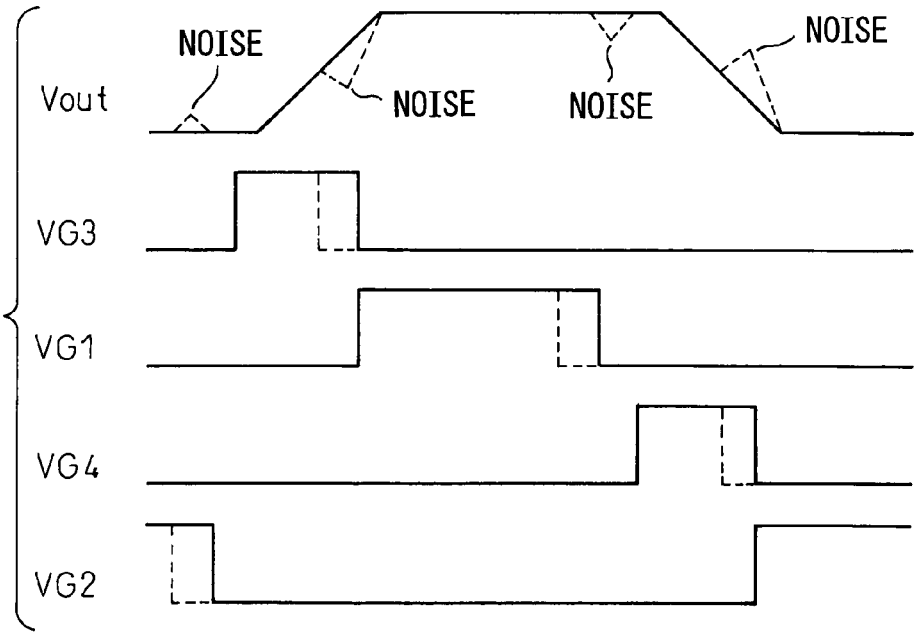
Fig.10 (PRIOR ART)
FIG. 10 is a diagram showing operating waveforms when the output pulse width is small in the prior art sustain circuit.

FIG. 10 is a diagram showing the operating waveforms when the output pulse width is small in the prior art sustain circuit.

As shown in FIG. 10, when the pulse widths of the signals VG1 and VG2 are reduced, the ON periods of the switch devices 31 and 33 become shorter. This results in a high impedance state even in a period during which the waveform must be clamped at the sustain supply voltage Vs or ground potential GND. As a result, noise may be superimposed on the waveform in the high level "H" period or low level "L" period of the sustain voltage (output signal of the sustain circuit) Vout.

On the other hand, when the pulse widths of the signals VG3 and VG4 are reduced, there arises the possibility that the switch devices 37 and 40, respectively, may be forcefully turned off when the signals VG3 and VG4 fall while the respective switch devices 37 and 40 are conducting. If the switch devices 37 and 40 are forcefully turned off, the power loss of the switch devices 37 and 40 may increase, or noise may be superimposed on the rising waveform and falling waveform of the sustain voltage Vout shown in FIG. 10.

If noise occurs due to the high impedance state, or noise is superimposed on the rising waveform and falling waveform of the sustain voltage, the operating margin in the plasma display apparatus decreases, resulting in the occurrence of screen flicker.

In the above description, the delay time in the amplifying circuit has been assumed to be zero, but actually, delay time also occurs in the amplifying circuit, and the delay time varies due to such factors as parts variations in the amplifying circuit. The four delay circuits (51, 52, 53, and 54) shown in FIG. 5 are each constructed to adjust the delay time T1 of the front edge independently of each other, in order to absorb variations in the delay times in the corresponding amplifying circuits (32, 34, 41, and 38); as a result, the characteristic associated with the pulse width (output pulse width) Two of the output signal Vo differs from one amplifying circuit to another. This gives rise to another problem that must be solved; that is, the problems such as the reduction of time margin and the development of abnormal current that occur when the output pulse width increases, as well as the problems such as the superimposition of noise on the sustain voltage Vout that occur when the output pulse width decreases, become more likely to occur.

An object of the present invention is to provide a capacitive load driving circuit that can supply a proper output voltage to a capacitive load by reducing the variation in output signal pulse width that occurs in such cases as when the delay time is adjusted using a delay circuit. Another object of the invention is to provide a plasma display apparatus that can supply a plasma display panel with a drive voltage free from such problems as the reduction of time margin, the occurrence of abnormal current, the superimposition of noise, etc.

Below, embodiments of the capacitive load driving circuit and the plasma display apparatus according to the present invention will be described in detail with reference to the accompanying drawings. It will be appreciated here that the display apparatus and its driving method according to the present invention are not limited in application to plasma display apparatuses employing the ALIS method, but can be applied widely to plasma display apparatuses employing various other methods.

Figure 11:
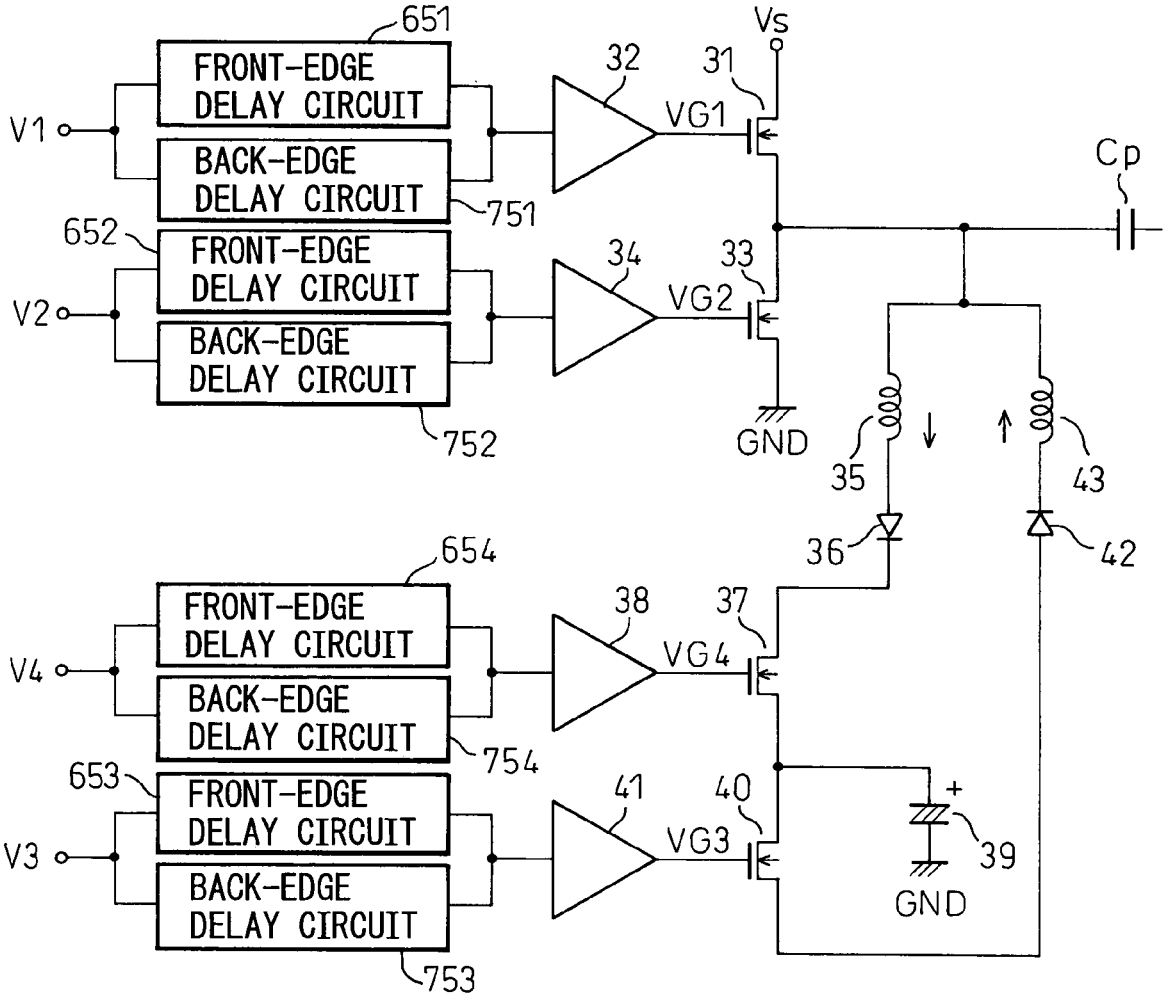
FIG. 11 is a block circuit diagram showing the general configuration of one example of a capacitive load driving circuit according to the present invention.

FIG. 11 is a block circuit diagram showing the generation configuration of one example of the capacitive load driving circuit according to the present invention.

As is apparent from a comparison of FIG. 11 and FIG. 5, the one example of the capacitive load driving circuit according to the present invention shown in FIG. 11 corresponds to a circuit in which the delay circuits 51 to 54 in the prior art sustain circuit (capacitive load driving circuit) shown in FIG. 5 are constructed from front-edge delay circuits 651 to 654 and back-edge delay circuits 751 to 754, respectively. Accordingly, the driving operation of the drive capacitor Cp by the switch devices (sustain output devices: n-channel MOS transistors) 31 and 33 and amplifying circuits (drive circuits) 32 and 34, the operation of the power recovery circuit by the switch devices 37 and 40, amplifying circuits 38 and 41, diodes 36 and 42, coils 35 and 43, and capacitor 39 (Cp), etc. are the same as those described in detail with reference to FIG. 5, and the description will not be repeated there.

As shown in FIG. 11, the one example of the capacitive load driving circuit according to the present invention comprises the front-edge delay circuits 651 and 652 for delaying the front edges of the respective input signals V1 and V2, the back-edge delay circuits 751 and 752 for delaying the back edges of the respective input signals V1 and V2, the amplifying circuits 32 and 34 for amplifying the drive control signals obtained through the respective front-edge delay circuits 651 and 652 and back-edge delay circuits 751 and 752, and the switch devices 31 and 33 driven by the respective amplifying circuits 32 and 34. Here, the front-edge delay circuits (651, 652) and the back-edge delay circuits (751, 752) are connected in parallel to each other.

The one example of the capacitive load driving circuit according to the present invention further comprises the front-edge delay circuits 653 and 654 for delaying the front edges of the respective input signals V3 and V4, the back-edge delay circuits 753 and 754 for delaying the back edges of the respective input signals V3 and V4, the amplifying circuits 41 and 38 for amplifying the drive control signals obtained through the respective front-edge delay circuits 653 and 654 and back-edge delay circuits 753 and 754, and the power recovery circuit comprising, as described with reference to FIG. 5, the switch devices 40 and 37 driven by the respective amplifying circuits 41 and 38, the diodes 36 and 42, the coils 35 and 43, and the capacitor 39. Here, the front-edge delay circuits (653, 654) and the back-edge delay circuits (753, 754) are connected in parallel to each other.

Figure 12:
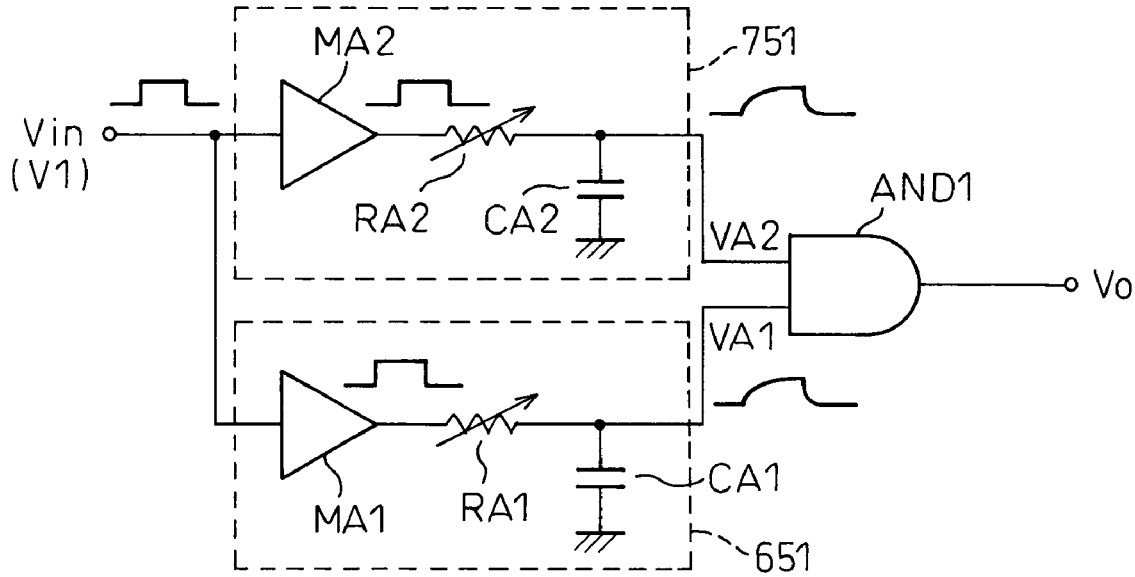
FIG. 12 is a circuit diagram showing an essential portion of a first embodiment of the capacitive load driving circuit according to the present invention.
Figure 13:
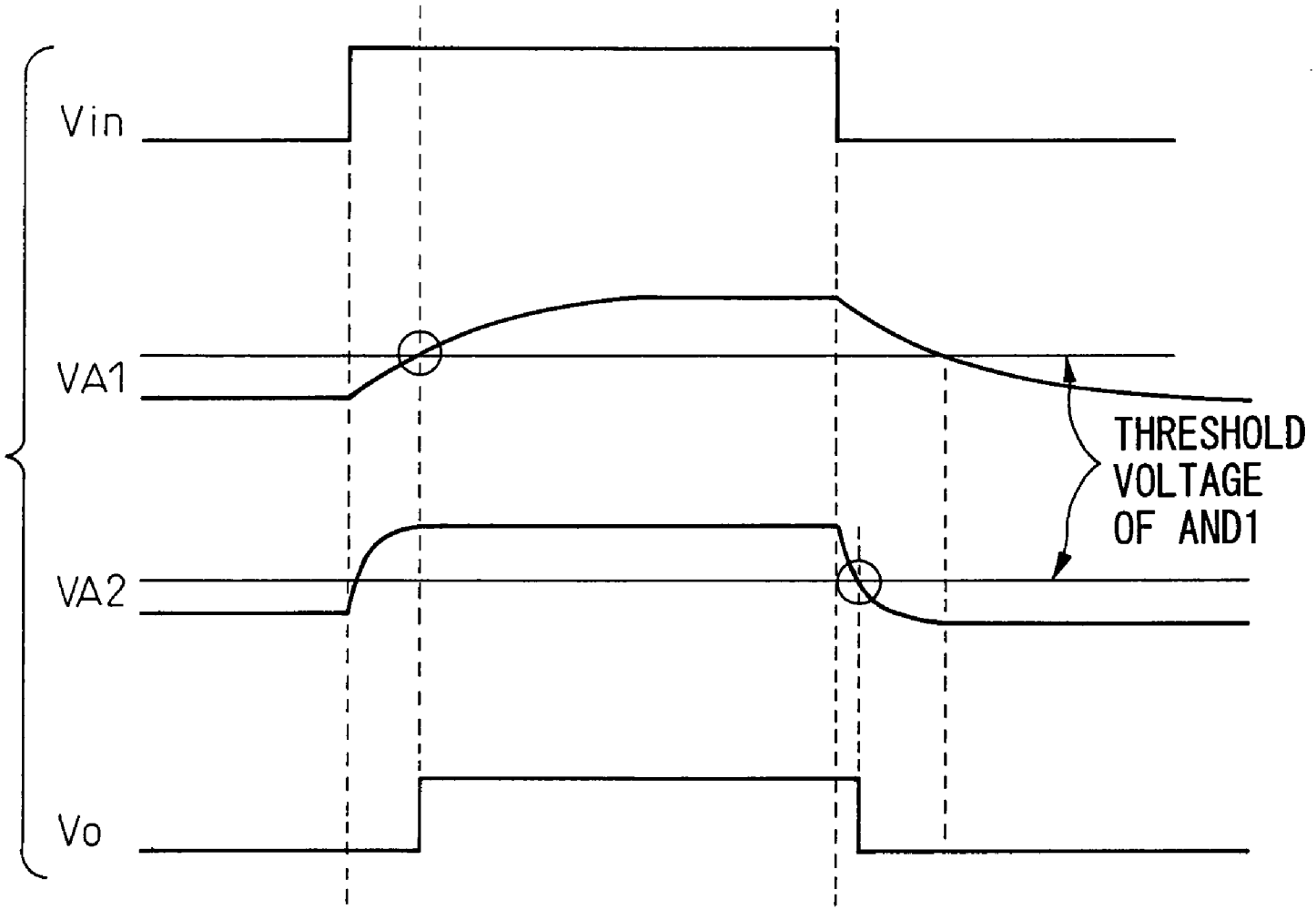
FIG. 13 is a diagram for explaining the operation of the capacitive load driving circuit shown in FIG. 12.

FIG. 12 is a circuit diagram showing an essential portion of a first embodiment of the capacitive load driving circuit according to the present invention, and FIG. 13 is a diagram for explaining the operation of the capacitive load driving circuit shown in FIG. 12.

As shown in FIG. 12, in the capacitive load driving circuit of the first embodiment, the front-edge delay circuit 651 is constructed from a time-constant circuit comprising a noninverting buffer circuit MA1, a resistor RA1, and a capacitor CA1, and the back-edge delay circuit 751 is constructed from a time-constant circuit comprising a noninverting buffer circuit MA2, a resistor RA2, and a capacitor CA2. The front-edge delay time and the back-edge delay time are adjusted by adjusting the values of the resistors RA1 and RA2, respectively.

Further, the output signal of the front-edge delay circuit 651 and the output signal of the back-edge delay circuit 751 are combined by an AND gate AND1 at the following stage, to obtain an output signal (output voltage) Vo such as shown in FIG. 13.

In this way, by using the circuit shown in FIG. 12, the front-edge delay time and the back-edge delay time can be adjusted independently of each other. Here, in the circuit shown in FIG. 12, the front-edge delay circuit 651 and the back-edge delay circuit 751 are provided with the buffer circuits MA1 and MA2, respectively, at the front end of the respective time-constant circuits in order to prevent the back-edge delay time from changing due to the interference caused when the front-edge delay time is adjusted, while also preventing the front-edge delay time from changing due to the interference caused when the back-edge delay time is adjusted. That is, with the provision of the buffer circuits MA1 and MA2, the capacitive load driving circuit of the first embodiment can set the pulse width of the output voltage Vo with higher accuracy.

Figure 14:
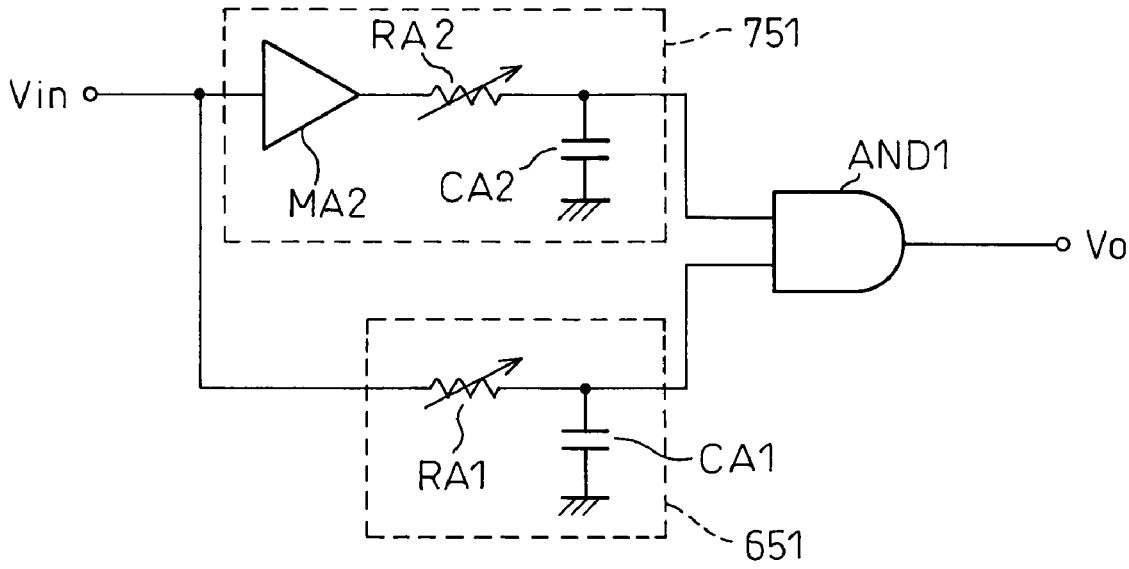
FIG. 14 is a circuit diagram showing an essential portion of a second embodiment of the capacitive load driving circuit according to the present invention.

FIG. 14 is a circuit diagram showing an essential portion of a second embodiment of the capacitive load driving circuit according to the present invention.

As is apparent from a comparison of FIG. 14 and FIG. 12, in the capacitive load driving circuit of the second embodiment, the buffer circuit MA1 is omitted from the front-edge delay circuit 651 in the capacitive load driving circuit of the first embodiment shown in FIG. 12, and the buffer circuit MA2 provided at the front end of the time-constant circuit in the back-edge delay circuit 751 functions to prevent the front-edge delay time from changing due to the interference caused when the back-edge delay time is adjusted. That is, in the capacitive load driving circuit of the second embodiment, the pulse width of the output signal can be set accurately by first adjusting the front-edge delay time by varying the resistor RA1, and then adjusting the back-edge delay time by varying the resistor RA2. According to the capacitive load driving circuit of the second embodiment, the circuit configuration can be simplified because there is no need to provide the buffer circuit MA1 in the front-edge delay circuit 651.

Figure 15:
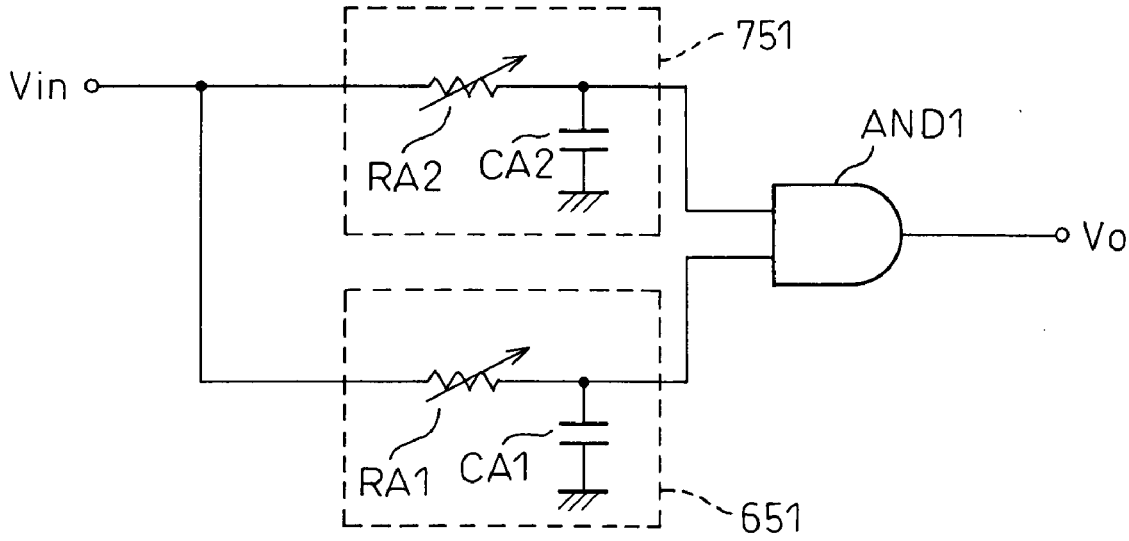
FIG. 15 is a circuit diagram showing an essential portion of a third embodiment of the capacitive load driving circuit according to the present invention.

FIG. 15 is a circuit diagram showing an essential portion of a third embodiment of the capacitive load driving circuit according to the present invention.

As is apparent from a comparison of FIG. 15 and FIG. 12, in the capacitive load driving circuit of the third embodiment, the buffer circuit MA1 in the front-edge delay circuit 651 and the buffer circuit MA2 in the back-edge delay circuit 751 are both omitted from the capacitive load driving circuit of the first embodiment shown in FIG. 12. In this case, the adjustment of the front-edge delay time performed by varying the resistor RA1 and the adjustment of the back-edge delay time performed by varying the resistor RA2 interfere with each other, but the pulse width of the output signal Vo can be set, for example, by adjusting the resistors RA1 and RA2 repeatedly; this configuration is suitable for applications where the circuit needs to be further simplified by omitting the buffer circuits MA1 and MA2.

Figure 16:
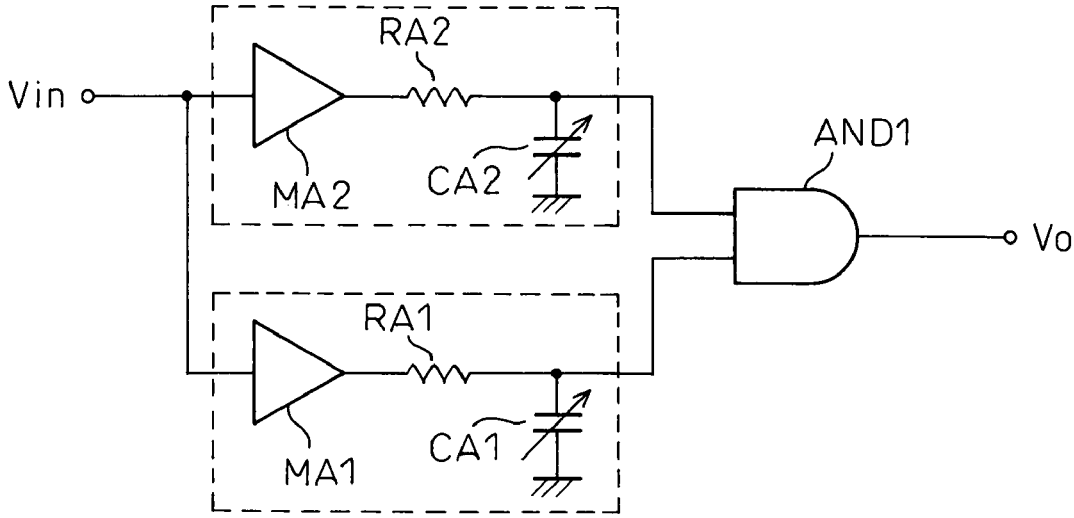
FIG. 16 is a circuit diagram showing an essential portion of a fourth embodiment of the capacitive load driving circuit according to the present invention.

FIG. 16 is a circuit diagram showing an essential portion of a fourth embodiment of the capacitive load driving circuit according to the present invention.

As is apparent from a comparison of FIG. 16 and FIG. 12, in the capacitive load driving circuit of the fourth embodiment, the resistors RA1 and RA2 in the capacitive load driving circuit of the first embodiment shown in FIG. 12 are replaced by fixed resistors, and instead, the capacitors CA1 and CA2 are formed as variable capacitors so that the front-edge delay time and the back-edge delay time can be adjusted by varying the respective capacitors CA1 and CA2. Even when the capacitors CA1 and CA2 are formed as variable capacitors, one or both of the buffer circuits MA1 and MA2 provided at the front ends of the respective time-constant circuits can be omitted, as in the second and third embodiments described above.

Figure 17:
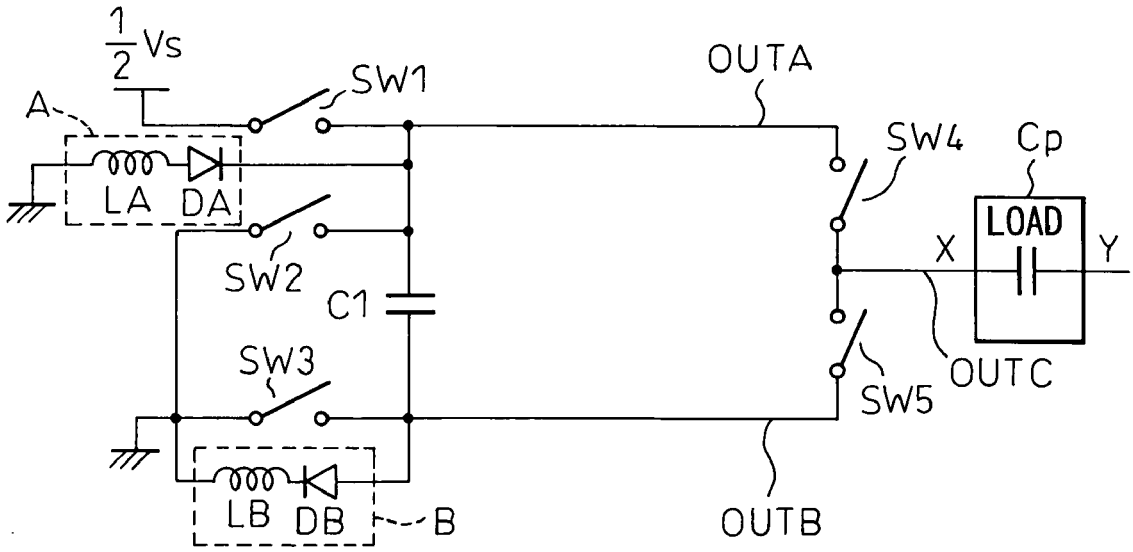
FIG. 17 is a circuit diagram schematically showing the general configuration of another example of the capacitive load driving circuit according to the present invention.
Figure 18:
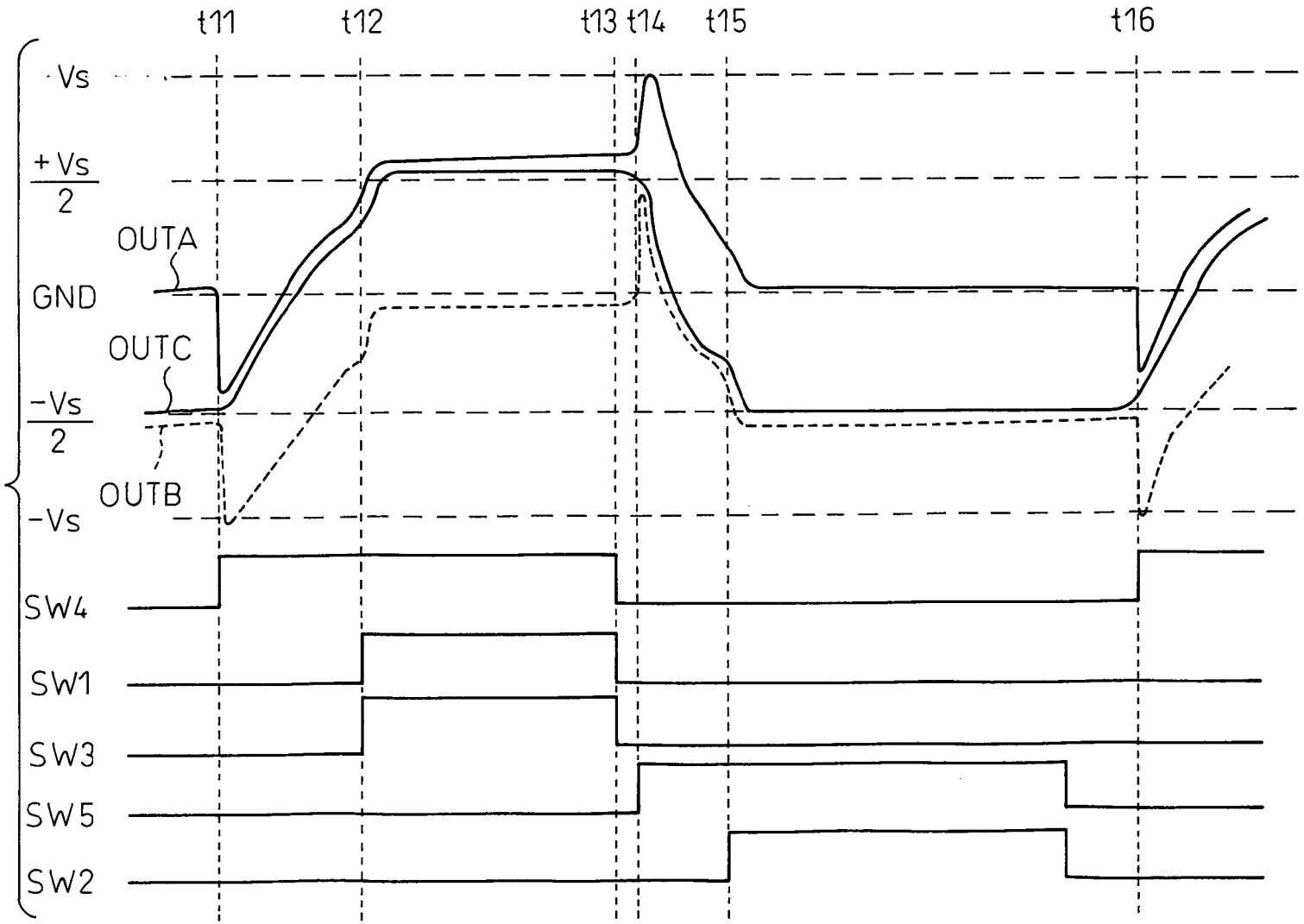
FIG. 18 is a diagram for explaining the operation of the capacitive load driving circuit shown in FIG. 17.

FIG. 17 is a circuit diagram schematically showing the general configuration of another example of the capacitive load driving circuit according to the present invention, and FIG. 18 is a diagram for explaining the operation of the capacitive load driving circuit shown in FIG. 17. The circuit shown in FIG. 17 is essentially the same as the circuit disclosed, for example, in Japanese Patent Application No. 2003-425666.

The operation of the capacitive load driving circuit shown in FIG. 17 will be described with reference to FIG. 18.

In FIG. 18, waveforms SW1 to SW5 are the signal waveforms for driving the switches SW1 to SW5 in FIG. 17, and the switches SW1 to SW5 are ON when the corresponding waveforms are high "H". That is, as shown in FIG. 18, in the capacitive load driving circuit shown in FIG. 17, the switch SW4 is turned on at time t12, and a power recovering current flows via a coil (inductance) LA, a diode DA, and the switch SW4. At time t12, the switch SW1 is turned on, and a charge current flows from a ½ Vs power supply to a capacitive load (drive capacitor) Cp via the switches SW1 and SW4. At this time, the switch SW3 is also turned on, and a charge current flows to the capacitive load Cp via the switch SW3 and capacitor C1.

Next, at time t13, the switches SW1, SW3, and SW4 are turned off, and at time t14, the switch SW5 is turned on. When the switch SW5 is turned on, a power recovering current flows out of the capacitive load Cp through a diode DB and coil LB. Further, at time t15, the switch SW2 is turned on, and a discharge current flows out of the capacitive load Cp through the switch SW5, the capacitor C1, and the switch SW2.

In the above operation, the waveform shown by OUTC in FIG. 18 is supplied to the capacitive load Cp. Further, in this operation, the waveforms of OUTA and OUTB in the circuit diagram of FIG. 17 are as shown by the waveforms indicated by a solid curve and a dashed curve, respectively, in FIG. 18.

In the capacitive load driving circuit shown in FIG. 17, when supplying the driving pulse to the capacitive load Cp, the power recovering current is made to flow via the coil LA during the rising of the pulse and via the coil LB during the falling of the pulse, thereby reducing the switching losses of the switches SW1 and SW2. When the capacitive load driving circuit shown in FIG. 17 is used to drive the plasma display apparatus, the power consumption of the driving circuit can be reduced with simple circuitry.

FIGS. 19 to 22 are circuit diagrams showing fifth to eighth embodiments of the capacitive load driving circuit according to the present invention, each showing a specific configuration example of the circuit of FIG. 17.

As is apparent from a comparison of FIGS. 19 to 22 and FIG. 17, in the capacitive load driving circuits according to the fifth of eighth embodiments, power MOSFETs are used as the switches SW1 to SW5. Here, the switches SW1, SW2, SW4, and SW5 are each constructed from an n-channel MOS transistor. On the other hand, the switch SW3 comprises a p-channel MOS transistor SW3P and an n-channel MOS transistor SW3N, to which diodes DSW3P, DSW3N, and D3P, a resistor R3P, and a capacitor C3P are attached. Since the switch SW3P (p-channel MOS transistor) is an active-low device, an inverter IN3P is provided at the front end of an amplifying circuit (173P) that drives the switch SW3P. The operation of each of the capacitive load driving circuits according to the fifth of eighth embodiments shown in FIGS. 19 to 22 is essentially the same as that described with reference to FIGS. 17 and 18.

Figure 19:
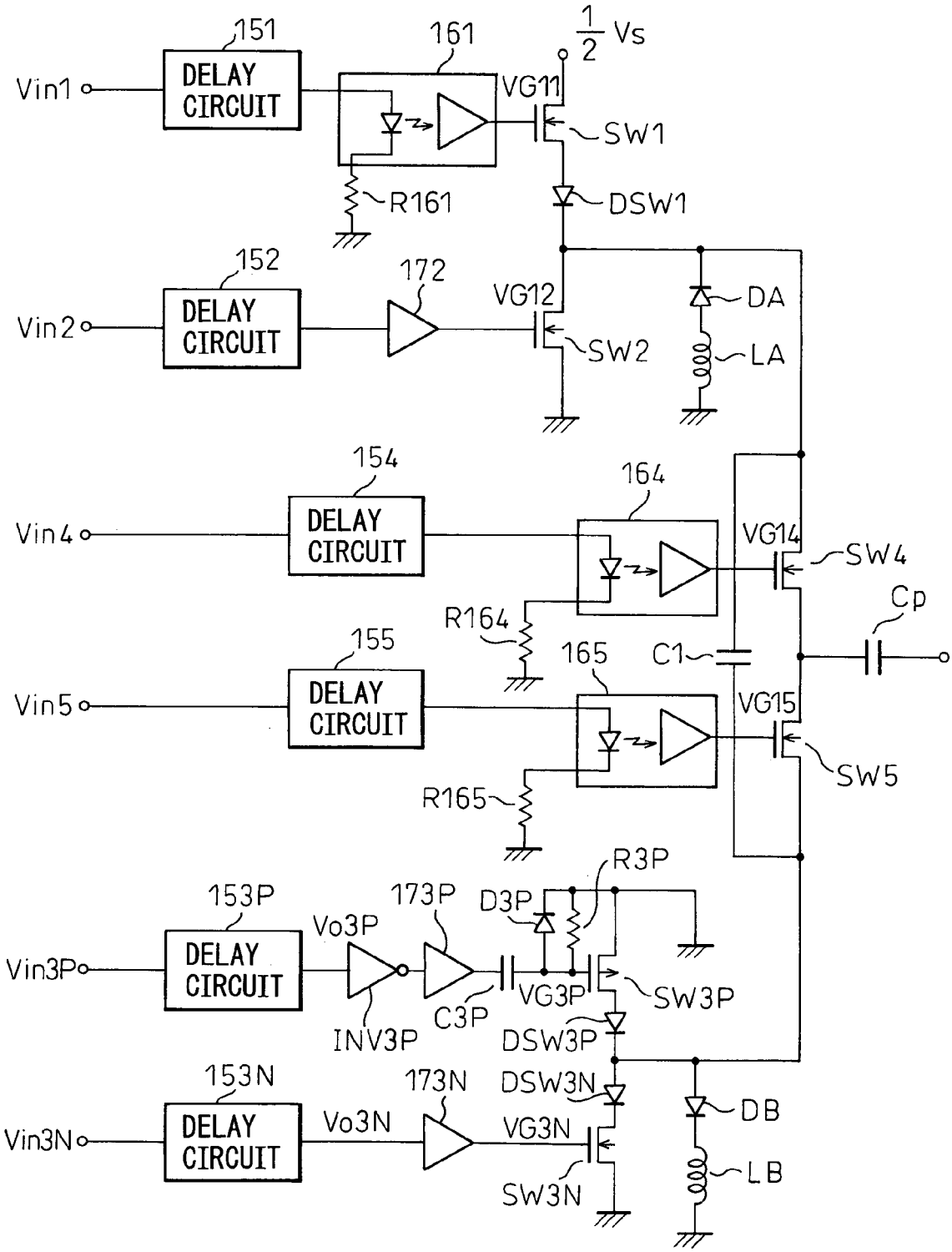
FIG. 19 is a circuit diagram showing a fifth embodiment of the capacitive load driving circuit according to the present invention.

As shown in FIG. 19, in the capacitive load driving circuit of the fifth embodiment, gate couplers 161, 164, and 165 are used to drive the switches (power MOSFETs) SW1, SW4, and SW5, respectively, while amplifying circuits 172, 173P, and 173N are used to drive the switches SW2, SW3P, and SW3N, respectively. Further, in the capacitive load driving circuit of the fifth embodiment, the gate couplers 161, 164, and 165 and the amplifying circuits 172, 173P, and 173N are preceded by delay circuits 151, 154, and 155 and delay circuits 152, 153P, and 153N, respectively.

Here, the circuit configuration previously shown in FIG. 14, for example, is employed for each of the delay circuits 151, 152, 153P, 153N, 154, and 155, and the delay circuits adjust the delay times for the front and back edges of the respective input signals Vin1, Vin2, Vin3P, Vin3N, Vin4, and Vin5 independently of each other, to correctly control the switching operations of the corresponding switches SW1, SW2, SW3P, SW3N, SW4, and SW5. The delay circuit configuration is not limited to that shown in FIG. 4, but the circuit configuration shown in FIG. 12, 15, or 16 can also be employed; further, various other circuit configurations can also be employed, including the one to be described later with reference to FIG. 23 in which a front-edge delay circuit 611 and a back-edge delay circuit 711 are connected in series. The gate couplers 161, 164, and 165 are each constructed using a light-emitting device, a light-receiving device, and an amplifying circuit so that the signal can be accurately transmitted even when the reference voltage is different between the input and output ends. The gate couplers 161, 164, and 165 are also provided with resistors R161, R164, and R165, respectively.

In this way, according to the capacitive load driving circuit of the fifth embodiment, the delay circuits 151, 152, 153P, 153N, 154, and 155 are provided for the respective switches SW1, SW2, SW3P, SW3N, SW4, and SW5, and the delay times for the front and back edges of the respective input signals Vin1, Vin2, Vin3P, Vin3N, Vin4, and Vin5 are adjusted independently of each other so that the drive pulse phase and pulse width can be set accurately.

Figure 20:
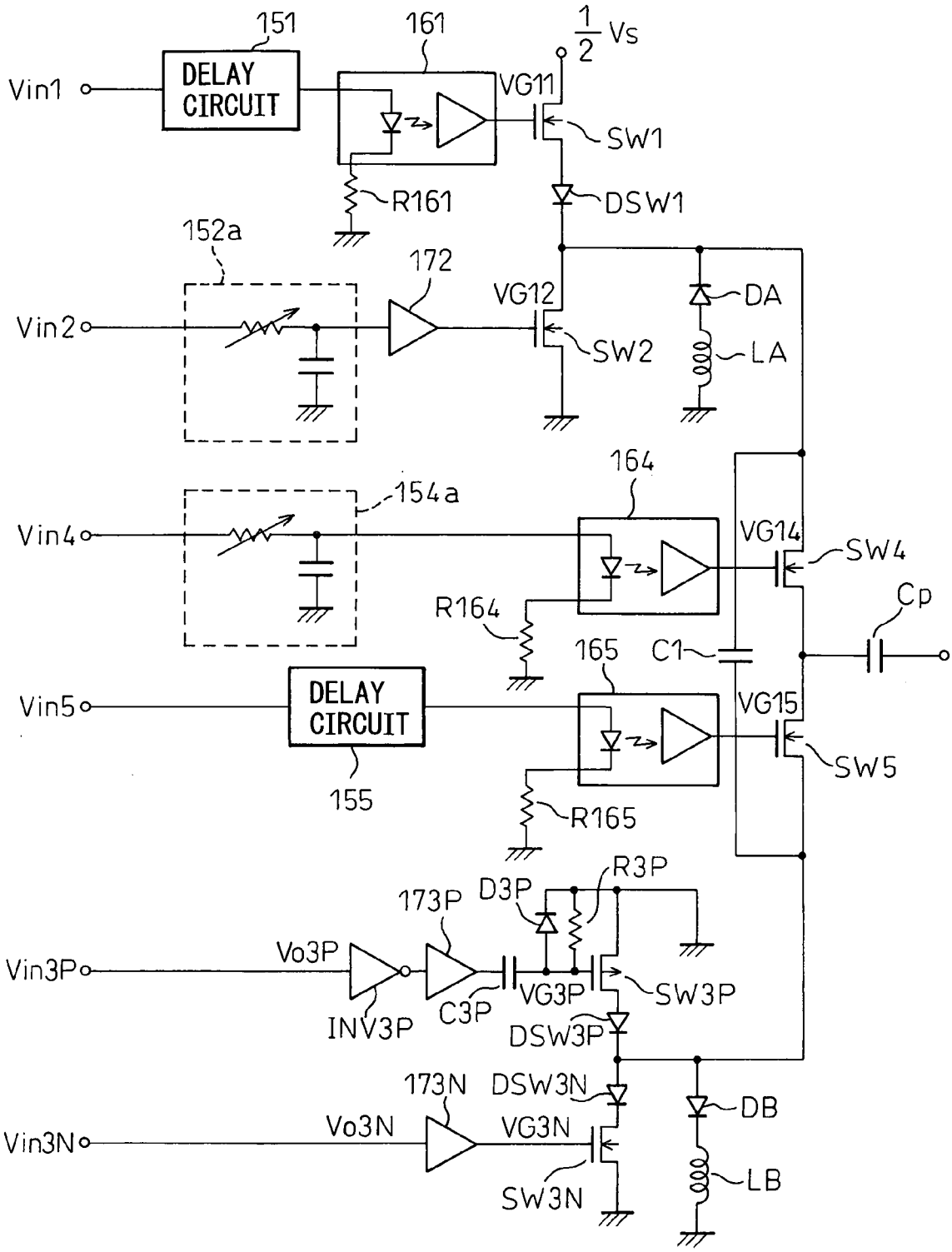
FIG. 20 is a circuit diagram showing a sixth embodiment of the capacitive load driving circuit according to the present invention.

FIG. 20 is a circuit diagram showing the sixth embodiment of the capacitive load driving circuit according to the present invention.

As shown in FIG. 20, in the capacitive load driving circuit of the sixth embodiment, the delay circuits 152 and 154 for the switches SW2 and SW4 are each constructed as a front-edge delay circuit comprising a variable resistor and a capacitor. More specifically, the delay circuits 151 and 155, each having the same configuration, for example, as that shown in FIG. 14, are provided at the front ends of the respective gate couplers 161 and 165 that supply the driving pulses to the switches SW1 and SW5 for which the front-edge delay time and pulse width need to be set with high accuracy; on the other hand, the front-edge delay circuits 152*a* and 154*a* are provided at the front ends of the amplifying circuit 172 and the gate coupler 164, respectively, that supply the driving pulses to the switches SW2 and SW4 for which the front-edge delay time needs to be set with high accuracy. The delay circuits 153P and 153N for the switches SW3P and SW3N in the fifth embodiment shown in FIG. 19 are omitted here.

That is, in the capacitive load driving circuit of the sixth embodiment, the delay circuits 151 and 155 for setting the front-edge delay time and pulse width with high accuracy and the front-edge delay circuits 152*a* and 154*a* for setting the front-edge delay time with high accuracy are provided by limiting the portions where high accuracy is required in the capacitive load driving circuit of the fifth embodiment shown in FIG. 19; this serves to simplify the circuit configuration compared with that of the fifth embodiment. Here, it will be appreciated that the configuration of each of the delay circuits 151 and 155 is not limited to that shown in FIG. 14, and also that the front-edge delay circuits 152*a* and 154*a* are not limited to those shown in FIG. 20.

Figure 21:
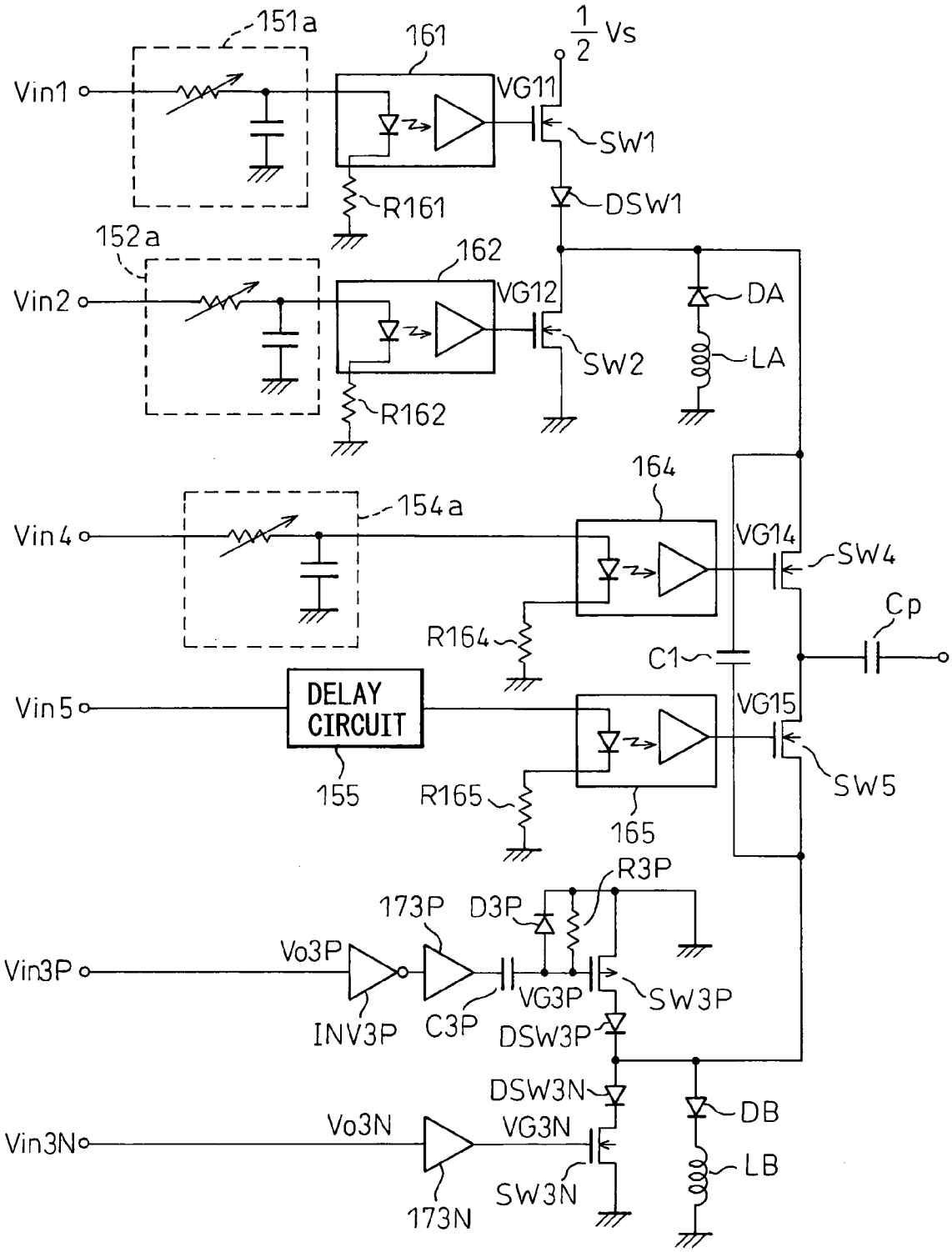
FIG. 21 is a circuit diagram showing a seventh embodiment of the capacitive load driving circuit according to the present invention.

FIG. 21 is a circuit diagram showing the seventh embodiment of the capacitive load driving circuit according to the present invention.

As is apparent from a comparison of FIG. 21 and FIG. 20, the capacitive load driving circuit of the seventh embodiment differs from the capacitive load driving circuit of the foregoing sixth embodiment in that the amplifying circuit (buffer) 172 is replaced by a gate coupler 162, and in that the delay circuit 151 for the switch SW1 is replaced by a front-edge delay circuit 151*a*. When the gate coupler 162 is used as the drive circuit for driving the switch SW2, since the drive circuits for the switches SW1 and SW2 can be made identical in configuration, it becomes possible to reduce the amount of change of the input/output delay time that occurs in the drive circuits, for example, when the ambient temperature changes.

Figure 22:
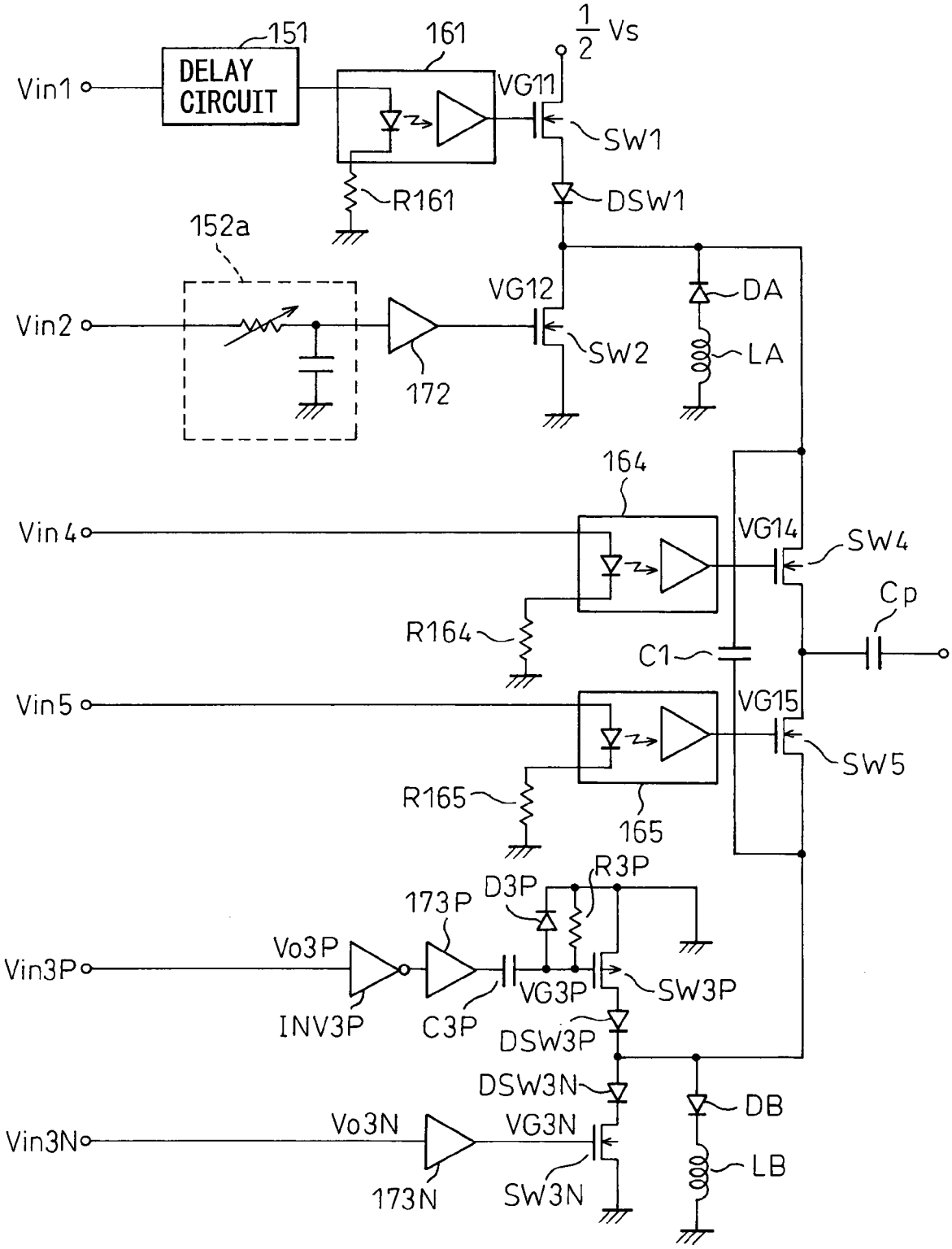
FIG. 22 is a circuit diagram showing an eighth embodiment of the capacitive load driving circuit according to the present invention.

FIG. 22 is a circuit diagram showing the eighth embodiment of the capacitive load driving circuit according to the present invention.

As is apparent from a comparison of FIG. 22 and FIG. 20, the capacitive load driving circuit of the eighth embodiment differs from the capacitive load driving circuit of the sixth embodiment in that the front-edge delay circuit 154*a* for the switch SW4 and the delay circuit 155 for the switch SW5 are further omitted.

That is, in the capacitive load driving circuit of the eighth embodiment, the portions where high accuracy is required are further limited in the capacitive load driving circuit of the sixth embodiment shown in FIG. 20, and the delay circuit 151 for setting the front-edge delay time and pulse width with high accuracy is provided at the front end of the gate coupler 161 that drives the switch SW1 which, of the switches SW1 to SW5, demands the highest accuracy in the setting of the front-edge delay time and pulse width, while the front-edge delay circuit 152*a* is provided at the front end of the amplifying circuit 172 that drives the switch SW2 which demands high accuracy in the setting of the front-edge delay time.

The capacitive load driving circuit of the eighth embodiment is used, for example, as a driving circuit for a plasma display apparatus; here, a gas discharge current is made to flow by turning on the switch SW1 and thereby supplying a positive-going sustain voltage to the plasma display panel which is a capacitive load, and a negative-going sustain voltage is supplied to the plasma display panel by turning on the switch SW2.

In this way, the capacitive load driving circuit of the eighth embodiment shown in FIG. 22 achieves further simplification in circuit configuration, compared with the capacitive load driving circuit of the sixth embodiment shown in FIG. 20.

As shown in the embodiments of FIGS. 19 to 22 described above, for the delay circuits 151, 152, 153P, 153N, 154, and 155 in FIG. 19, a delay circuit constructed by combining a front-edge delay circuit and a back-edge delay circuit, a circuit constructed by combining a front-edge delay circuit and a pulse width adjusting circuit, and a circuit constructed from a front-edge delay circuit alone can be combined in various ways in accordance with such requirements as the driving signal timing accuracy required and the amount of circuitry allowed, for example, when using the capacitive load driving circuit as a driving circuit for a plasma display apparatus.

Figure 23:
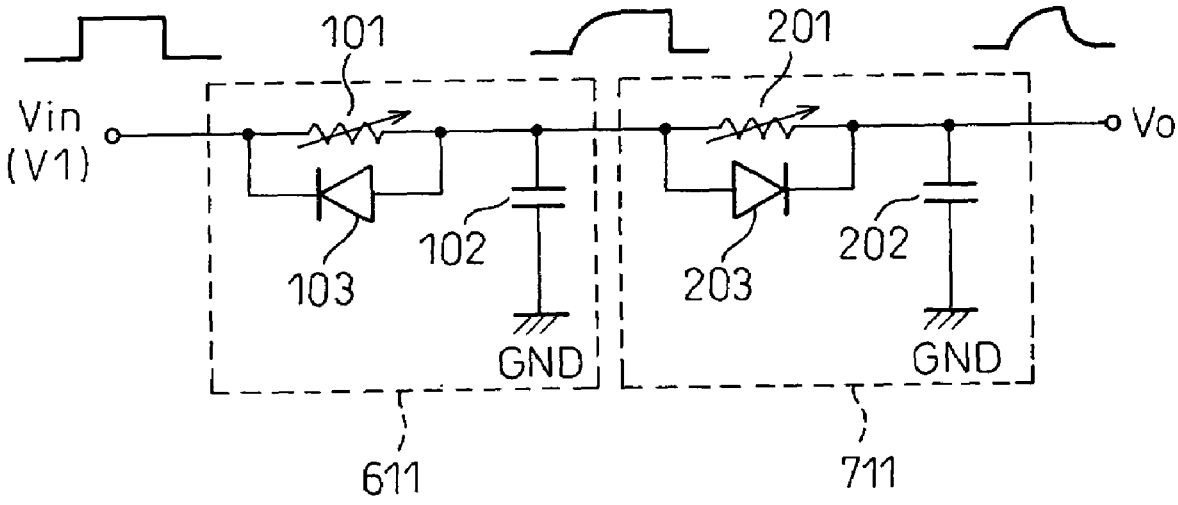
FIG. 23 is a circuit diagram showing a modified example of a delay circuit in the capacitive load driving circuit according to the present invention.

FIG. 23 is a circuit diagram showing a modified example of the delay circuit in the capacitive load driving circuit according to the present invention, in which the front-edge delay circuit 611 and the back-edge delay circuit 711 are connected in series.

As shown in FIG. 23, the front-edge delay circuit 611 comprises a variable resistor (variable resistive element) 101, a capacitor (capacitive element) 102, and a diode 103, and the back-edge delay circuit 711 comprises a variable resistor 201, a capacitor 202, and a diode 203. Here, in the front-edge delay circuit 611, the variable resistor 101 is connected in parallel to the diode 103 directed in the reverse direction with respect to the input signal Vin (V1), and one end of the capacitor 102 whose other end is connected to ground GND is connected to the output-side connection node between the variable resistor 101 and the diode 103. On the other hand, in the back-edge delay circuit 711, the variable resistor 201 is connected in parallel to the diode 203 directed in the forward direction with respect to the input signal Vin, and one end of the capacitor 202 whose other end is connected to ground GND is connected to the output-side connection node between the variable resistor 201 and the diode 203. Here, a positive polarity pulse signal is used as the input signal Vin.

In this way, for the delay circuits in the capacitive load driving circuits of the fifth to eighth embodiments of the present invention shown in FIGS. 19 to 22, the circuit configuration in which the front-edge delay circuit and the back-edge delay circuit are connected in series can be employed as well as the circuit configuration in which the front-edge delay circuit and the back-edge delay circuit are connected in parallel as shown in FIGS. 12 and 14 to 16.

Each of the above-described embodiments of the capacitive load driving circuit, when applied to the sustain circuit in the plasma display apparatus such as described with reference to FIGS. 1 to 4B, can solve the various problems, such as the reduction of time margin, the occurrence of abnormal current, and the superimposition of noise, that can arise when the delay time in the sustain circuit is adjusted.

According to the present invention, a capacitive load driving circuit can be provided that is configured to supply a proper output voltage to the capacitive load by reducing the variation in output signal pulse width that occurs in such cases as when the delay time is adjusted using a delay circuit. Furthermore, according to the present invention, a plasma display apparatus can be achieved that can supply a plasma display panel with a drive voltage free from such problems as the reduction of time margin, the occurrence of abnormal current, the superimposition of noise, etc.

The present invention can be applied widely to plasma display apparatuses; for example, the invention can be applied to plasma display apparatuses that are used as display apparatuses for personal computers, workstations, etc. or as hang-on-the-wall flat-screen televisions or advertisement or like information displaying apparatuses.

Many different embodiments of the present invention may be constructed without departing from the scope of the present invention, and it should be understood that the present invention is not limited to the specific embodiments described in this specification, except as defined in the appended claims.

What is claimed is:

1. A capacitive load driving circuit comprising:

an input terminal;

a front-edge delay circuit delaying a front edge of an input signal input via said input terminal;

a back-edge delay circuit delaying a back edge of said input signal;

an amplifying circuit amplifying a drive control signal obtained through said front-edge delay circuit and said back-edge delay circuit; and an output switch device which is driven by said amplifying circuit, wherein said front-edge delay circuit includes a first time-constant circuit comprising a first resistor and a first capacitor, said back-edge delay circuit includes a second time-constant circuit comprising a second resistor and a second capacitor, said drive control signal is generated by a signal combining circuit which combines an output signal of said first-time constant circuit with an output signal of said second-time constant circuit, and a buffer circuit is provided at a front end of either one or each of said first and second time-constant circuits.

2. The capacitive load driving circuit as claimed in claim 1, wherein delay time of said front edge is adjusted by adjusting the value of said first capacitor in said first time-constant circuit, and delay time of said back edge is adjusted by adjusting the value of said second capacitor in said second time-constant circuit.

3. The capacitive load driving circuit as claimed in claim 1, wherein said signal combining circuit is an AND gate.

4. The capacitive load driving circuit as claimed in claim 1, wherein delay time of said front edge is adjusted by adjusting the value of said first resistor in said first time-constant circuit, and delay time of said back edge is adjusted by adjusting the value of said second resistor in said second time-constant circuit.

5. A capacitive load driving circuit for a matrix-addressed flat panel display apparatus which applies a prescribed voltage to a capacitive load that forms a display element, comprising:

a first signal line supplying a first potential to one end of said capacitive load;

a first switch device supplying said first potential to said first signal line;

a first drive circuit driving said first switch device;

a second switch device supplying a second potential to said first signal line;

a second drive circuit driving said second switch device;

a second signal line supplying a third potential to said one end of said capacitive load, said third potential being different from said first potential;

a first capacitor connected between said first signal line and said second signal line and capable of supplying a potential lower than said first and said second potential to said first signal line;

a third switch device supplying said second potential to said second signal line;

a third drive circuit driving said third switch device;

a fourth switch device connecting said first signal line to said one end of said capacitive load;

a fourth drive circuit driving said fourth switch device;

a fifth switch device connecting said second signal line to said one end of said capacitive load;

a fifth drive circuit driving said fifth switch device; and a coil circuit which is connected between at least one of said first and second signal lines and a supply line supplying said second potential, wherein said capacitive load driving circuit further includes, at a front end of one of said first to fifth drive circuits, an input terminal, a front-edge delay circuit delaying a front edge of an input signal input via said input terminal, and a back-edge delay circuit delaying a back edge of said input signal.

6. The capacitive load driving circuit as claimed in claim 5, wherein a gate coupler constructed by using a light-emitting device, a light-receiving device, and an amplifying circuit is employed for at least one of said first to fifth drive circuits.

7. The capacitive load driving circuit as claimed in claim 5, wherein said input terminal, said front-edge delay circuit delaying the front edge of said input signal input via said input terminal, and said back-edge delay circuit delaying the back edge of said input signal are provided at the front end of said first drive circuit.

8. The capacitive load driving circuit as claimed in claim 7, wherein said capacitive load driving circuit further includes, at the front end of said second drive circuit, an input terminal, and a front-edge delay circuit delaying the front edge of an input signal input via said input terminal.

9. The capacitive load driving circuit as claimed in claim 7, wherein said capacitive load driving circuit further includes, at the front end of said fifth drive circuit, an input terminal, and a front-edge delay circuit delaying the front edge of an input signal input via said input terminal, and also includes, at the front end of each of said second and fourth drive circuits, an input terminal, and a front-edge delay circuit delaying the front edge of an input signal input via said input terminal.

10. The capacitive load driving circuit as claimed in claim 5, wherein said third switch device comprises a current output device and a current input device, and said third drive circuit comprises a current output device drive circuit driving said current output device and a current input device drive circuit driving said current input device.

11. The capacitive load driving circuit as claimed in claim 10, wherein said current output device is a P-channel power MOSFET, and said current input device is an N-channel power MOSFET or an IGBT.

12. The capacitive load driving circuit as claimed in claim 11, wherein a front-edge delay circuit delaying the front edge of a driving signal to be supplied to said current output device drive circuit and a back-edge delay circuit delaying the back edge of said driving signal to be supplied to said current output device drive circuit are provided at the front end of said current output device drive circuit.

13. The capacitive load driving circuit as claimed in claim 11, wherein a front-edge delay circuit delaying the front edge of a driving signal to be supplied to a corresponding one of said drive circuits and a back-edge delay circuit delaying the back edge of said driving signal to be supplied to said corresponding drive circuit are provided at the front end of each of said first drive circuit, said second drive circuit, said fourth drive circuit, said fifth drive circuit, said current output device drive circuit, and said current input device drive circuit.

14. The capacitive load driving circuit as claimed in claim 5, wherein said front-edge delay circuit includes a first time-constant circuit comprising a first resistor and a first capacitor;

said back-edge delay circuit includes a second time-constant circuit comprising a second resistor and a second capacitor; and drive control signals to be supplied to said first to fifth drive circuits are each generated by a signal combining circuit which combines an output signal of said first-time constant circuit with an output signal of said second-time constant circuit.

15. The capacitive load driving circuit as claimed in claim 14, wherein a buffer circuit is provided at a front end of either one or each of said first and second time-constant circuits.

16. The capacitive load driving circuit as claimed in claim 14, wherein said signal combining circuit is an AND gate.

17. The capacitive load driving circuit as claimed in claim 14, wherein delay time of said front edge is adjusted by adjusting the value of said first resistor in said first time-constant circuit, and delay time of said back edge is adjusted by adjusting the value of said second resistor in said second time-constant circuit.

18. The capacitive load driving circuit as claimed in claim 14, wherein delay time of said front edge is adjusted by adjusting the value of said first capacitor in said first time-constant circuit, and delay time of said back edge is adjusted by adjusting the value of said second capacitor in said second time-constant circuit.

19. The capacitive load driving circuit as claimed in claim 6, wherein said gate coupler is employed for each of said first, second, fourth, and fifth drive circuits.

20. The capacitive load driving circuit as claimed in claim 6, wherein said gate coupler is employed for each of said fourth and fifth drive circuits.

21. A plasma display apparatus comprising:

a plurality of X electrodes;

a plurality of Y electrodes which are arranged substantially parallel to said plurality of X electrodes, and which produce a discharge between said plurality of Y electrodes and said plurality of X electrodes;

an X-electrode driving circuit which applies a discharge voltage to said plurality of X electrodes; and a Y-electrode driving circuit which applies a discharge voltage to said plurality of Y electrodes, and wherein:

said X-electrode driving circuit or said Y-electrode driving circuit is constructed using a capacitive load driving circuit, wherein said capacitive load driving circuit comprises:

an input terminal;

a front-edge delay circuit delaying a front edge of an input signal input via said input terminal;

a back-edge delay circuit delaying a back edge of said input signal;

an amplifying circuit amplifying a drive control signal obtained through said front-edge delay circuit and said back-edge delay circuit; and an output switch device which is driven by said amplifying circuit, wherein said front-edge delay circuit includes a first time-constant circuit comprising a first resistor and a first capacitor, said back-edge delay circuit includes a second time-constant circuit comprising a second resistor and a second capacitor, said drive control signal is generated by a signal combining circuit which combines an output signal of said first-time constant circuit with an output signal of said second-time constant circuit, a buffer circuit is provided at a front end of either one or each of said first and second time-constant circuits.

22. The plasma display apparatus as claimed in claim 21, wherein said capacitive load driving circuit is a sustain/scan common circuit supplying, to a plasma display panel, sustain pulses during a sustain period and scan pulses during a scan period.

23. The plasma display apparatus as claimed in claim 21, wherein said capacitive load driving circuit is a sustain circuit supplying sustain pulses to a plasma display panel during a sustain period.

24. The plasma display apparatus as claimed in claim 21, wherein said capacitive load driving circuit is a scan circuit supplying scan pulses to a plasma display panel during a scan period.

25. A plasma display apparatus comprising:

a plurality of X electrodes;

a plurality of Y electrodes which are arranged substantially parallel to said plurality of X electrodes, and which produce a discharge between said plurality of Y electrodes and said plurality of X electrodes;

an X-electrode driving circuit which applies a discharge voltage to said plurality of X electrodes; and a Y-electrode driving circuit which applies a discharge voltage to said plurality of Y electrodes, and wherein:

said X-electrode driving circuit or said Y-electrode driving circuit is constructed using a capacitive load driving circuit which applies a prescribed voltage to a capacitive load that forms a display element, wherein said capacitive load driving circuit comprises:

a first signal line supplying a first potential to one end of said capacitive load;

a first switch device supplying said first potential to said first signal line;

a first drive circuit driving said first switch device;

a second switch device supplying a second potential to said first signal line;

a second drive circuit driving said second switch device;

a second signal line supplying a third potential to said one end of said capacitive load, said third potential being different from said first potential;

a first capacitor connected between said first signal line and said second signal line and capable of supplying a potential lower than said first and said second potential to said first signal line;

a third switch device supplying said second potential to said second signal line;

a third drive circuit driving said third switch device;

a fourth switch device connecting said first signal line to said one end of said capacitive load;

a fourth drive circuit driving said fourth switch device;

a fifth switch device connecting said second signal line to said one end of said capacitive load;

a fifth drive circuit driving said fifth switch device; and a coil circuit which is connected between at least one of said first and second signal lines and a supply line supplying said second potential, wherein said capacitive load driving circuit further includes, at a front end of one of said first to fifth drive circuits, an input terminal, a front-edge delay circuit delaying a front edge of an input signal input via said input terminal, and a back-edge delay circuit delaying a back edge of said input signal.

26. The plasma display apparatus as claimed in claim 25, wherein said capacitive load driving circuit is a sustain/scan common circuit supplying, to a plasma display panel, sustain pulses during a sustain period and scan pulses during a scan period.

27. The plasma display apparatus as claimed in claim 25, wherein said capacitive load driving circuit is a sustain circuit supplying sustain pulses to a plasma display panel during a sustain period.

28. The plasma display apparatus as claimed in claim 25, wherein said capacitive load driving circuit is a scan circuit supplying scan pulses to a plasma display panel during a scan period.

* * * * *

UNITED STATES PATENT AND TRADEMARK OFFICE

CERTIFICATE OF CORRECTION

PATENT NO. : 7,211,963 B2
APPLICATION NO. : 11/072604
DATED : May 1, 2007
INVENTOR(S) : Makoto Onozawa et al.

It is certified that error appears in the above-identified patent and that said Letters Patent is hereby corrected as shown below:

Column 20, Line 48, after "circuit," insert --and--.

Signed and Sealed this

Seventh Day of August, 2007

JON W. DUDAS
*Director of the United States Patent and Trademark Office*